US006110629A

United States Patent [19]

Ehara et al.

[11] Patent Number: 6,110,629

[45] **Date of Patent: *Aug. 29, 2000**

[54] ELECTROPHOTOGRAPHIC, PHOTOSENSITIVE MEMBER AND IMAGE FORMING APPARATUS

[75] Inventors: Toshiyuki Ehara; Yuji Nakayama, both of Yokohama; Tetsuya Karaki, Shizuoka-ken; Hironori Owaki, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/310,987

[22] Filed: May 13, 1999

[30] Foreign Application Priority Data

May 14, 1998 [JP] Japan ..... 10-132245
May 15, 1998 [JP] Japan ..... 10-133896

[51] Int. Cl.[7] ..... G03G 5/10; G03G 5/082; G03G 15/00

[52] U.S. Cl. ..... 430/84; 430/69; 430/95; 399/159

[58] Field of Search ..... 430/69, 84, 95

[56] References Cited

U.S. PATENT DOCUMENTS

| | | | |
|---|---|---|---|
| 4,461,820 | 7/1984 | Shiral | 430/65 |
| 4,689,283 | 8/1987 | Fumiyuki et al. | 430/69 |
| 4,689,284 | 8/1987 | Kawamura et al. | 430/84 |
| 4,814,248 | 3/1989 | Kamata et al. | 430/69 |
| 4,895,784 | 1/1990 | Shirai | 430/69 |
| 5,191,381 | 3/1993 | Yuan | 399/90 |
| 5,592,274 | 1/1997 | Higashi et al. | 399/174 |
| 5,595,848 | 1/1997 | Ohtaka et al. | 430/69 |
| 5,729,800 | 3/1998 | Ohba et al. | 399/159 |
| 5,923,925 | 7/1999 | Nakumura et al. | 399/159 |
| 5,943,531 | 8/1999 | Talai et al. | 399/159 |

FOREIGN PATENT DOCUMENTS

| | | |
|---|---|---|
| 2746967 | 4/1979 | Germany . |
| 2855718 | 6/1979 | Germany . |
| 53-146341 | 12/1978 | Japan . |
| 55-40161 | 10/1980 | Japan . |
| 59-191065 | 10/1984 | Japan . |
| 63-91664 | 4/1988 | Japan . |
| 63-121851 | 5/1988 | Japan . |
| 63-210864 | 9/1988 | Japan . |
| 01-238677 | 9/1989 | Japan . |
| 02-251866 | 10/1990 | Japan . |
| 62-175781 | 8/1997 | Japan . |

*Primary Examiner*—Roland Martin
*Attorney, Agent, or Firm*—Fitzpatrick, Cella, Harper & Scinto

[57] ABSTRACT

A cylindrical, photosensitive member is disclosed which has a photosensitive layer comprising amorphous silicon provided on an electroconductive substrate, and in which the thickness of the electroconductive substrate is not less than 0.1 mm but less than 2.5 mm, thereby accomplishing cost reduction of the photosensitive member and also accomplishing prevention of variations of image density and image smearing by high-accuracy temperature control.

8 Claims, 9 Drawing Sheets

ELECTROPHOTOGRAPHIC, PHOTOSENSITIVE MEMBER AND IMAGE FORMING APPARATUS

BACKGROUND OF THE INVENTION

1. Field of the Invention

The present invention relates to an electrophotographic, photosensitive member and an image forming apparatus having the photosensitive member and, more particularly, to an electrophotographic, photosensitive member capable of achieving lower cost and an image forming apparatus (electrophotographic apparatus) making use of the so-called electrophotographic system having the photosensitive member.

2. Related Background Art

It is required that a photoconductive material for forming a photoconductive layer in an image forming member for electrophotography in the field of formation of image have the following characteristics; for example, having high sensitivity, a high S/N ratio [photocurrent (Ip)/dark current (Id)], absorption spectral characteristics matched with spectral characteristics of an electromagnetic wave radiated thereto (which is light in a general sense, such as ultraviolet light, visible light, infrared light, X-ray, γ-ray, or the like), quick optical response, and a desired dark resistance, being nonpolluting to human bodies during use, and so on. Particularly, in the case of the image forming members for electrophotography incorporated in electrophotographic apparatus used as business machines in offices, the above-stated nonpolluting property during use is a significant point.

On the basis of this viewpoint, for example, German Patent Application Laid-Open Nos. 2746967 and 2855718 describe the application of amorphous silicon in which dangling bonds are compensated with a univalent element such as hydrogen (H), halogen (X), or the like (hereinafter referred to as a-Si(H,X)), to the image forming members for electrophotography, and such materials are applied to the image forming members for electrophotography because of their excellent photoconductive property, wear resistance, and heat resistance, and relative easiness of increase of area to a larger area.

In producing a photosensitive drum for electrophotography having the photoconductive material containing a-Si(H,X), in order to obtain good photoconductive characteristics, it is common practice to deposit an a-Si(H,X) film in the thickness of 1 to 100 μm on a drum-like metal substrate under such a condition that the drum-like metal substrate is continuously heated at relatively higher temperature, 200° C. to 350° C., than in the case of Se-based materials, in an a-Si(H,X) film deposition system. This maintenance of heating of the substrate at the high temperature is necessary for production of the a-Si-based photosensitive drum with excellent electrophotographic characteristics and it is the present status that this maintenance of heating at the high temperature ranges from several hours to somewhat more than 10 hours, based on consideration of deposition rates of the a-Si(H,X) film.

The photoconductive member for electrophotography, in its preferred embodiment, is constructed in such structure that a drum-like, or cylindrical, metal substrate of Al or an Al alloy or the like (hereinafter referred to as an Al-based substrate) is used as a metal support for the photoconductive member for electrophotography and that a photoconductive layer containing an amorphous material having the matrix of silicon and preferably containing at least either one of hydrogen and halogen as a constituent element is formed on the drum-like Al-based metal substrate. The photoconductive layer may have a blocking layer in contact with the drum-like metal substrate and further have a surface blocking layer in the surface of the photoconductive layer.

FIGS. 1A and 1B are views for explaining an example of the layer structure of the a-Si photosensitive member.

FIG. 1A is a schematic, perspective view, in which reference numeral 2100 indicates the thickness of the photosensitive member including a support 2101 and a photoreceptive layer 2105.

FIG. 1B is a schematic, sectional view, in which on the electroconductive substrate 2101 of aluminum or the like there are successively stacked layers, i.e., a charge injection inhibiting layer 2102 for inhibiting injection of charge from the conductive support 2101, and a photoconductive layer 2103 for creating electrons and holes with irradiation of light and converting image information to potential information. Each of these layers is comprised of a material having the matrix of amorphous silicon and, if necessary, containing a neutralizer of the dangling bonds, such as hydrogen and/or halogen, or the like, a valency controller of an element belonging to Group III, Group V, or the like, a modifying substance such as oxygen, carbon, nitrogen, or the like, and so on as occasion may demand. On the upper surface of the photoconductive layer 2103 in the figure, there is provided a surface protecting layer 2104 for protecting the photoconductive layer from friction or the like against a developer, a transfer sheet, a cleaning device, etc. and for preventing charge from being injected from the surface to the photoconductive layer. The surface protecting layer 2104 is comprised of a material of a-SiC:H with excellent light transmittancy to the photoconductive layer, excellent mechanical strength, excellent effect of preventing injection of charge from the top, and so on.

Materials preferably used as a base material for the drum-like (hollow cylinder shape) metal substrate are, for example, metals such as NiCr, stainless steel, Al, Cr, Mo, Au, Nb, Ta, V, Ti, Pt, Pd, and so on, or alloys thereof. Particularly, Al and Al-based alloys are preferably applicable.

The reasons why aluminum or the aluminum-based alloys are preferably used as a base material for the drum-like substrate are that it is relatively easy to obtain the substrate with high accuracies of roundness, surface smoothness, etc., it is easy to control the temperature of the surface part of the a-Si(H,X) deposition during production, and they are economical.

The halogen atoms (X) which the photoconductive layer of the photoconductive member may contain are, specifically, fluorine, chlorine, bromine, or iodine, among which chlorine is particularly preferred and fluorine is more particularly preferred. The photoconductive layer can contain another component or other components than the silicon atoms, hydrogen atoms, and halogen atoms, as a valency controller, as a modifying substance, or the like, as described above, which are one or an appropriate combination selected from the atoms belonging to Group III of the periodic table such as boron, gallium, and so on (hereinafter referred to as III atoms), the atoms belonging to Group V of the periodic table such as nitrogen, phosphorus, arsenic, etc. (hereinafter referred to as V atoms), oxygen atoms, carbon atoms, germanium atoms, etc. as a component for controlling the Fermi level, the bandgap, and so on.

The blocking layer is provided for the purpose of enhancing the adhesion between the photoconductive layer and the drum-like metal substrate or for the purpose of controlling charge receptibility or the like and the blocking layer is constructed in a single layer or in multiple layers of a-Si(H,X) or polycrystal-Si containing III atoms, V atoms, oxygen atoms, carbon atoms, germanium atoms, etc. according to the purpose.

The layer above the photoconductive layer may be provided as a surface charge injection inhibiting layer or as a protecting layer, which is a layer comprised of an amorphous material having the matrix of silicon atoms, containing carbon atoms, nitrogen atoms, oxygen atoms, etc., preferably, in a large amount and, if necessary, containing hydrogen atoms or halogen atoms, or a layer comprised of a high-resistance organic substance.

The photoconductive layer comprised of a-Si(H,X) is formed by conventionally known vacuum deposition methods utilizing various discharge phenomena, for example, such as a glow discharge method, a sputtering method, an ion plating method, and so on.

Next described is an example of a method for producing the photoconductive member (photosensitive member) for electrophotography by the glow discharge decomposition method.

FIG. 2 shows an example of a system for producing the photosensitive member for electrophotography by the glow discharge decomposition method. A deposition chamber 1 is constructed of a base plate 2, a wall 3, and a top plate 4, and a cathode electrode 5 of a cylindrical shape is provided inside the deposition chamber 1. A drum-like metal substrate 6 on which an a-Si(H,X) deposited film is to be deposited is set in the central part of the cathode electrode 5 (at the center of concentric circles) and also serves as an anode electrode.

For forming the a-Si(H,X) deposited film on the drum-like metal substrate by this production system, first, a source gas inflow valve 7 and a leak valve 8 are closed and an exhaust valve 9 is opened to evacuate the inside of the deposition chamber 1. When the reading of a vacuum gage 10 reaches about $5\times10^{-6}$ Torr, the source gas inflow valve 7 is opened to allow a source mixture gas, for example, of $SiH_4$ gas, $Si_2H_6$ gas, $SiF_4$ gas, etc., adjusted at a predetermined mixture ratio in a mass flow controller 11 to flow into the deposition chamber 1. At this time the ratio of the value opening of the exhaust valve 9 is adjusted by checking the reading of the vacuum gage 10 so that the pressure inside the deposition chamber 1 becomes a desired value. After it is confirmed that the surface temperature of the drum-like metal substrate 6 is set at a prescribed temperature by a heater 12, a high-frequency power supply 13 is set to a desired power to bring about glow discharge in the deposition chamber 1.

During execution of formation of the layer the drum-like metal substrate 6 is rotated at a constant rate by a motor 14 in order to uniformly deposit the layer. The a-Si(H,X) deposited film can be formed on the drum-like metal substrate 6 in this way.

However, because of the difference between coefficients of thermal expansion of the drum-like metal substrate and the a-Si(H,X) film and large internal stress in the a-Si(H,X) film formed, it was not rare to encounter peeling of the a-Si(H,X) film off the drum-like metal substrate, not only during the deposition of the a-Si(H,X) film in which the drum-like metal substrate was maintained as heated at the high temperature, as described previously, but also during the period of cooling down to the temperature of the outside atmosphere after the deposition. Further, there were more than a few cases in which the a-Si(H,X) film was peeled off because of heating of the drum depending upon the temperature of the operating environment during the use as a photosensitive drum for electrophotography. The film peeling off in the case of the a-Si(H,X) film occurred more readily as the thickness of the a-Si(H,X) film became larger. With thermal deformation of the drum-like metal substrate (which is, particularly, easy to occur during the formation of the photoconductive layer) even in such a degree as not to cause the film to peel off in the case of the conventional Se-based electrophotographic, photosensitive drums, there were more than a few cases in which the film peeling off occurred in the case of the a-Si(H,X)-based photosensitive drums, for the reason of the aforementioned difference between coefficients of thermal expansion and the magnitude of the internal stress in the a-Si(H,X) film. The internal stress in the a-Si(H,X) film can be relaxed to some extent by production conditions of the a-Si(H,X) film (kinds of source gases, a ratio of flow rates of the gases, discharge power, the heating temperature of the substrate, the internal structure of the production system, etc.), but production conditions are not yet sufficient yet when consideration is given to productivity and mass productivity. This film peeling off will cause image defects and be fatal in application to the photosensitive drum for electrophotography.

The high-temperature heating of the drum-like metal substrate over a long period during the production of the a-Si(H,X) film can be the cause of the above film peeling off and also make the thermal deformation of the drum-like metal substrate happen more readily. This thermal deformation causes nonuniformity of discharge during the production of the a-Si(H,X) deposited film, whereby evenness of thickness of the a-Si(H,X) deposited film is lost, which would be the cause of the image defects.

In view of the various points discussed above, an example of the photoconductive member for electrophotography intended to reduce the image defects is one in which the drum-like metal substrate is comprised of aluminum or an aluminum-based alloy and the thickness is not less than 2.5 mm, for example, as described in Japanese Patent Publication No. 6-14189.

Taking the recent cutthroat price competition and, particularly, development to middle- and low-speed models into consideration making operating cost low is not enough, and the point is how much the initial cost can be decreased. Therefore, an urgent necessity was to decrease the cost of the photoconductive member drastically.

The percentage of the raw material cost was large in the cost of the photoconductive member and decrease in the thickness of the drum-like metal substrate was thus expected to realize not only simple reduction of the raw material cost, but also additional cost reduction, including power savings and decrease in tack time resulting from decrease of the heating time during the production of the a-Si(H,X) film, a cutback of the power for maintaining the high temperature, decrease in the tack time resulting from reduction of the cooling time, and so on, for the reason of the low heat capacity resulting from the small thickness. Therefore, there were urgent desires for cost reduction of the drum-like metal substrate and improvement in temperature characteristics.

SUMMARY OF THE INVENTION

The present invention has been accomplished in view of the above problems and an object of the present invention is to provide an electrophotographic, photosensitive member and an image forming apparatus capable of stably providing high-quality images and permitting the decrease of cost toward the improvement in the temperature characteristics.

A further object of the present invention is to provide an electrophotographic, photosensitive member that permits power savings, decrease of tact time, and decrease of production cost in production of the electrophotographic, photosensitive member, and an image forming apparatus having the photosensitive member.

A further object of the present invention is to provide an electrophotographic, photosensitive member that can present high-quality images with fewer image defects of blank area or the like due to the film peeling off of the a-Si(H,X) deposited film and that can be produced at low cost, and an electrophotographic apparatus having the photosensitive member.

Another object of the present invention is to provide an electrophotographic apparatus incorporating a photoconductive member for electrophotography that always demonstrates stable, electrical, optical, and photoconductive properties, that suffers no deterioration in repetitive use, and that has excellent endurance.

According to the present invention, there is provided an electrophotographic, photosensitive member which is cylindrical and comprises a photosensitive layer comprising amorphous silicon provided on an electroconductive substrate and in which the thickness of the electroconductive substrate is not less than 0.1 mm but less than 2.5 mm, wherein the photosensitive layer is a layer formed by a plasma CVD method to induce a discharge at a discharge frequency of not less than 50 MHz nor more than 450 MHz, and an electrophotographic apparatus comprising the electrophotographic, photosensitive member.

According to the present invention, there is further provided an electrophotographic, photosensitive member which has a cylindrical shape and comprises a photosensitive layer comprising amorphous silicon provided on an electroconductive substrate, wherein the electroconductive substrate has a thickness of not less than 0.1 mm but less than 2.5 mm, and wherein the outside diameter of the cylinder is not less than 20 mm nor more than 60 mm, and an electrophotographic apparatus comprising the electrophotographic, photosensitive member.

DESCRIPTION OF THE PREFERRED EMBODIMENTS

The present invention is based on such a finding that the above problems including the film peeling off etc. were able to be solved even with the thin substrate by use of the drum-like metal substrate having a specific outside diameter as a support for the a-Si(H,X) deposited film, as a consequence of systematic, intensive and extensive studies and investigations from the viewpoints of adaptability and applicability of a-Si(H,X) to the photoconductive member used in the image forming member for electrophotography.

The drum-like metal substrate in the present invention is one having the thickness not less than 0.1 mm but less than 2.5 mm and the outside diameter not less than 20 mm nor more than 60 mm. With use of the drum-like metal substrate having the outside diameter not less than 20 mm nor more than 60 mm, even if the drum-like metal substrate is heated in the deposition system of the a-Si(H,X) film during the production of the photoconductive member or even if the drum-like metal substrate is heated during use as a photosensitive drum for electrophotography, the degree of thermal deformation of the drum-like metal substrate can be controlled to a sufficiently small level, so that the degree of the film peeling off of the a-Si(H,X) deposited film can be decreased to below a level in which no problem is posed in practical use, or to zero.

In the photosensitive member of the present invention, the electroconductive substrate is one having the thickness not less than 0.1 mm but less than 2.5 mm and the photoconductive member containing a-Si is made by the plasma CVD method to induce discharge at the discharge frequency not less than 50 MHz nor more than 450 MHz, whereby the degree of thermal deformation of the drum-like metal substrate can be suppressed to a sufficiently small level even if the drum-like metal substrate is heated in the a-Si(H,X) film deposition apparatus during the production of the photoconductive member or even if the drum-like metal substrate is heated during use as a photosensitive drum for electrophotography. Therefore, the degree of film peeling off of the a-Si(H,X) deposited film can be decreased to the level in which no problem is posed in practical use, or to zero. Further, deformation of the drum-like metal substrate due to stress of film can also be suppressed.

Figure 1A:
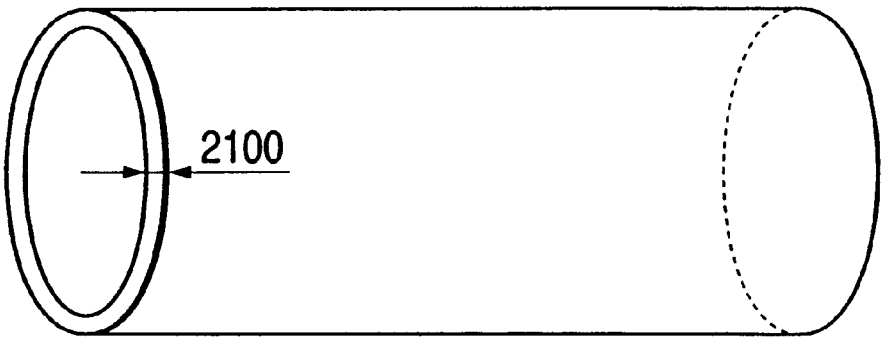
FIG. 1A is a schematic, perspective view of a photosensitive member
Figure 1B:
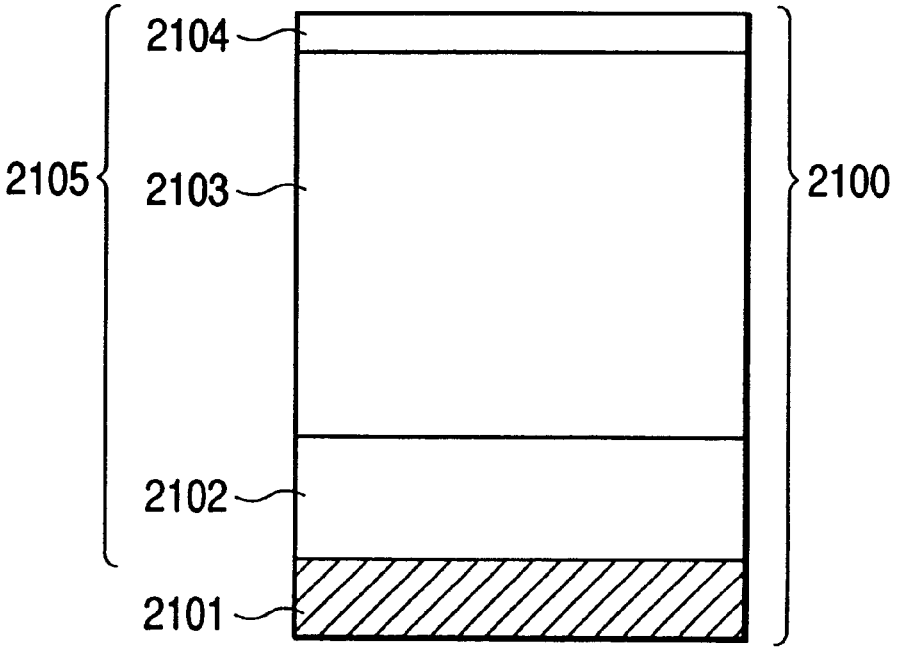
FIG. 1B is a schematic, sectional view of the photosensitive member.

It is also preferable that the photosensitive member of the present invention have the layer structure as illustrated in FIG. 1B. A preferred composition of each layer will be described below.

[Charge injection inhibiting layer]

The charge injection inhibiting layer in the electrophotographic, photosensitive member of the present invention has a function to inhibit charge from being injected from the conductive support side into the photoconductive layer side when the electrophotographic, photosensitive member undergoes a charging process of a certain polarity on its free surface, and also has a so-called polarity dependence not to demonstrate the function when it is subject to a charging process of the opposite polarity. In order to impart such functions, the inhibiting layer is made to contain a relatively larger amount of atoms for controlling the electroconductive property than the photoconductive layer. The atoms for controlling the electroconductive property, contained in the inhibiting layer, can be either the IIIb atoms or the Vb atoms. A content of the atoms for controlling the electroconductive property, contained in the inhibiting layer in the present invention, is properly determined as desired so as to accomplish the objects of the present invention effectively and it is desirable to determine the content preferably in the range of 10 to $1\times10^4$ atomic ppm, more preferably in the range of 50 to $5\times10^3$ atomic ppm, and most preferably in the range of $1\times10^2$ to $1\times10^3$ atomic ppm.

The hydrogen atoms and/or halogen atoms contained in the inhibiting layer compensate for dangling bonds existing in the layer so as to improve the quality of film. It is desirable to determine the content of the hydrogen atoms or halogen atoms or the content of the sum of the hydrogen atoms and halogen atoms in the inhibiting layer preferably in the range of 1 to 50 atomic %, more preferably in the range of 5 to 40 atomic %, and most preferably in the range of 10 to 30 atomic %.

It is desirable in the present invention to determine the thickness of the inhibiting layer preferably in the range of 0.1 to 5 $\mu$m and most preferably in the range of 1 to 4 $\mu$m in terms of capability of obtaining desired electrophotographic characteristics, the economical effect, and so on.

[Photoconductive layer]

The photoconductive layer in the electrophotographic, photosensitive member of the present invention needs to contain the hydrogen atoms or/and halogen atoms in the film. This is because they are necessary and indispensable for compensating for the dangling bonds of silicon atoms and for improving the quality of layer, particularly, for enhancing the photoconductive property and charge retaining characteristics. It is thus desirable to determine the content of the hydrogen atoms or halogen atoms or the total amount of the hydrogen atoms and halogen atoms in the range of 10 to 30 atomic % and more preferably in the range of 15 to 25 atomic % relative to the sum of the silicon atoms and the hydrogen atoms or/and halogen atoms. The amount of the hydrogen atoms or/and halogen atoms contained in the photoconductive layer can be controlled, for example, by controlling the temperature of the support, an introduced amount of the raw material for inclusion of the hydrogen atoms or/and halogen atoms into the reaction vessel, the discharge power, and so on.

It is preferable in the present invention to make the photoconductive layer contain the atoms for controlling the electroconductive property as occasion may demand. The atoms for controlling the electroconductive property can be those used for the inhibiting layer. It is desirable to determine the content of the atoms for controlling the electroconductive property present in the photoconductive layer, to be preferably in the range of $1\times10^{-2}$ to $1\times10^4$ atomic ppm, more preferably in the range of $5\times10^{-2}$ to $5\times10^3$ atomic ppm, and most preferably in the range of $1\times10^{-1}$ to $1\times10^3$ atomic ppm.

Further, in the present invention, it is effective to make the photoconductive layer contain carbon atoms, oxygen atoms, or nitrogen atoms. It is desirable to determine the content of the carbon atoms, oxygen atoms, or nitrogen atoms preferably in the range of $1\times10^{-5}$ to 10 atomic %, more preferably in the range of $1\times10^{-4}$ to 8 atomic %, and most preferably in the range of $1\times10^{-3}$ to 5 atomic % relative to the sum of the silicon atoms, carbon atoms, oxygen atoms, and nitrogen atoms. The carbon atoms, oxygen atoms, or nitrogen atoms do not always have to be contained throughout the entire layer, but they may be distributed only in a part thereof or across the thickness (with variations in density).

It is desirable in the present invention to determine the thickness of the photoconductive layer properly taking into account the desired electrophotographic characteristics, the economical effect, and so on, and to determine the thickness preferably in the range of 10 to 50 $\mu$m, more preferably in the range of 20 to 45 $\mu$m, and most preferably in the range of 25 to 40 $\mu$m.

[Surface protecting layer]

It is preferable in the present invention to further form the a-Si-based or a-C-based surface protecting layer on the photoconductive layer. This surface protecting layer has a free surface and is provided mainly for accomplishing the objects of the present invention in the moisture resistance, continuous and repetitive operation characteristics, dielectric strength, operating environment characteristics, and durability. In the present invention, because each of the amorphous materials forming the photoconductive layer and the surface protecting layer constituting the photoreceptive layer has the common component of silicon atoms, chemical stability is assured well at the stacking interface between the layers.

The surface protecting layer can be comprised of any a-Si-based or a-C-based material, and examples of preferred materials therefor are a-Si containing hydrogen atoms (H) and/or halogen atoms (X) and further containing carbon atoms (a-SiC:H,X), a-Si containing hydrogen atoms (H) and/or halogen atoms (X) and further containing oxygen atoms (a-SiO:H,X), a-Si containing hydrogen atoms (H) and/or halogen atoms (X) and further containing nitrogen atoms (a-SiN:H,X), a-Si containing hydrogen atoms (H) and/or halogen atoms (X) and further containing at least one of carbon, oxygen, and nitrogen (a-SiCON:H,X), and so on.

The content of an element or elements selected from carbon, nitrogen, and oxygen is preferably in the range of 30 atomic % to 90 atomic % relative to the sum of the silicon atoms and, the carbon atoms, nitrogen atoms, and/or oxygen atoms.

In the present invention, the surface protecting layer needs to contain hydrogen atoms or/and halogen atoms, and it is desirable to determine the hydrogen content normally in the range of 30 to 70 atomic %, preferably in the range of 35 to 65 atomic %, and most preferably in the range of 40 to 60 atomic % relative to the total amount of the component atoms. It is also desirable to determine the content of fluorine atoms normally in the range of 0.01 to 15 atomic %, preferably in the range of 0.1 to 10 atomic %, and most preferably in the range of 0.6 to 4 atomic %.

In the present invention, the surface protecting layer may further contain the atoms for controlling the conductivity type as occasion may demand.

It is desirable in the present invention to determine the thickness of the surface protecting layer normally in the range of 0.01 to 3 $\mu$m, preferably in the range of 0.1 to 2 $\mu$m, and most preferably in the range of 0.5 to 1 $\mu$m. If the thickness of the layer is smaller than 0.01 $\mu$m the surface protecting layer will be lost for the reason of wear or the like during use of the electrophotographic, photosensitive member. If the thickness is over 3 $\mu$m degradation will occur in the electrophotographic characteristics, such as increase of the residual potential and the like.

The atoms for controlling the conductivity type in the present invention, for example, specific examples of the IIIb atoms include B (boron), Al (aluminum), Ga (gallium), In (indium), Tl (thallium), and so on, among which B, Al, and Ga are particularly suitable. Specific examples of the Vb atoms are P (phosphorus), As (arsenic), Sb (antimony), Bi (bismuth), and so on, among which P and As are particularly suitable.

The IIIb atoms or the Vb atoms can be structurally introduced by introducing the raw material for introduction of the IIIb atoms or the raw material for introduction of the Vb atoms in a gas state, together with the other gases, into the reaction vessel on the occasion of formation of the layer. The raw material for introduction of the IIIb atoms or the raw material for introduction of the Vb atoms is desirably a gaseous material at ordinary temperature and ordinary pressure or a material that can be readily gasified at least under the film-forming conditions. Specific examples of the raw material for introduction of the IIIb atoms, e.g. for introduction of boron atoms, include boron hydrides such as $B_2H_6$, $B_4H_{10}$, $B_5H_9$, $B_5H_{11}$, $B_6H_{10}$, $B_6H_{12}$, and $B_6H_{14}$, boron halides such as $BF_3$, $BCl_3$, and $BBr_4$, and so on. Further examples include $AlCl_3$, $GaCl_3$, $Ga(CH_3)_3$, $InCl_3$, $TlCl_3$, and so on. Specific examples of the raw material effectively used for introduction of the Vb atoms, e.g. for introduction of phosphorus atoms, are phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$, and the like, and so on. Further examples of the raw material that can be effectively used as a starting substance for introduction of the Vb atoms include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, and so on. These raw materials for introduction of the atoms for controlling the conductivity type may be used as diluted with $H_2$ and/or He if necessary.

Substances that can be used as an Si-supplying gas in the present invention are gaseous or gasifiable silicon hydrides (silanes) such as $SiH_4$, $Si_2H_6$, $Si_3H_8$, $Si_4H_{10}$, etc. which can be used effectively in the present invention. Preferred materials are $SiH_4$ and $Si_2H_6$ in terms of ease to handle during formation of the layer, high Si supply efficiency, and so on.

The layer can also be formed by further mixing a desired amount of $H_2$ and/or He, or a gas of a silicon compound containing hydrogen atoms into the above-stated gases in order to structurally introduce the hydrogen atoms into each layer to be formed, further facilitate control of the rate of hydrogen atoms introduced, and obtain desired film characteristics to accomplish the objects of the present invention. Each gas may be not only a single species, but also a mixture of plural species at a predetermined mixture ratio.

The optimum range of flow rate of $H_2$ and/or He used as a dilution gas is properly selected according to the design of the layer, and it is desirable to control $H_2$ and/or He normally in the range of 3 to 20 times, preferably in the range of 4 to 15 times, and most preferably in the range of 5 to 10 times the flow rate of the gas for supply of Si.

Preferred examples of materials effectively used as the source gas for supply of halogen atoms in the present invention include gaseous or gasifiable halogen compounds such as halogen gases, halogenides, interhalogen compounds containing halogen, silane derivatives substituted by halogen, and so on. In addition, further materials effectively used are gaseous or gasifiable silicon hydride compounds containing halogen atoms, components of which are silicon atoms and halogen atoms. Specific examples of the halogen compounds that can be preferably used in the present invention are fluorine gas ($F_2$), and the interhalogen compounds such as BrF, ClF, $ClF_3$, $BrF_3$, $BrF_5$, $IF_3$, $IF_7$, and so on. Preferred examples of the silicon compounds containing halogen atoms, which are so called the silane derivatives substituted by halogen atoms, are, specifically, silicon fluorides, for example, such as $SiF_4$, $Si_2F_6$, and so on.

Substances that can be effectively used as a gas for supply of carbon are gaseous or gasifiable hydrocarbons such as $CH_4$, $C_2H_6$, $C_3H_8$, $C_4H_{10}$, etc. among which preferred hydrocarbons are $CH_4$ and $C_2H_6$ in terms of ease to handle during production of the layer, the high C supply efficiency, and so on.

Substances that can be effectively used as a gas for supply of nitrogen or oxygen are gaseous or gasifiable compounds such as $NH_3$, NO, $N_2O$, $NO_2$, $O_2$, CO, $CO_2$, $N_2$, and so on.

The atoms contained in each layer may be uniformly distributed throughout the layer, or may be contained throughout the layer in the layer thickness direction but nonuniformly distributed. In either case, it is, however, necessary to distribute the atoms uniformly and all over in the in-plane directions parallel to the surface of the support, from the aspect of uniforming the characteristics in the in-plane directions.

The optimum range of the gas pressure inside the reaction vessel is also properly selected according to the layer design and the pressure is determined normally in the range of $1\times10^{-4}$ to 10 Torr, preferably in the range of $5\times10^{-4}$ to 5 Torr, and most preferably in the range of $1\times10^{-3}$ to 1 Torr.

The optimum range of the discharge power is also properly selected according to the layer design, and it is desirable to set the discharge power per flow rate of the gas for supply of Si normally in the range of 2 to 7 times, preferably in the range of 2.5 to 6 times, and most preferably in the range of 3 to 5 times.

The optimum range of the temperature of the support is also properly selected according to the layer design and it is desirable normally to determine the temperature preferably in the range of 50 to 500° C. and more preferably in the range of 200 to 350° C.

In the present invention, the above-stated ranges can be listed as desired numerical ranges of the mixture ratio of the source gases for formation of each layer, the gas pressure, the temperature of the support, and the discharge power, but these conditions, normally, cannot be determined independent of each other. It is thus desirable to determine the optimum values, based on mutual and organic relation so as to form the deposited film with desired characteristics.

The photosensitive member for electrophotography of the present invention described above is formed by a vacuum deposited film forming method. Specifically, it can be formed by various thin film deposition methods, for example, such as the glow discharge methods (ac discharge CVD methods including low-frequency CVD methods, high-frequency CVD methods, microwave CVD methods, and so on, or dc discharge CVD methods, etc.), sputtering methods, vacuum evaporation methods, ion plating methods, photo CVD methods, thermal CVD methods, and so on. These thin film deposition methods are properly selected and employed depending upon factors including the production conditions, degrees of loads under capital investment on production facilities, production scale, desired characteristics for the electrophotographic, photosensitive member produced, and so on. The glow discharge methods are preferably used, because it is relatively easy to control the conditions for production of the electrophotographic, photosensitive member with the desired characteristics, and the high-frequency glow discharge methods using the power-supply frequency in the RF band or in the VHF band are particularly preferred. In the present invention, the deposited film is formed, for example, by the high-frequency plasma CVD method at the power-supply frequency in the VHF band, not less than 50 MHz nor more than 450 MHz.

The apparatus and forming method will be detailed below.

<Production apparatus>

Figure 3:
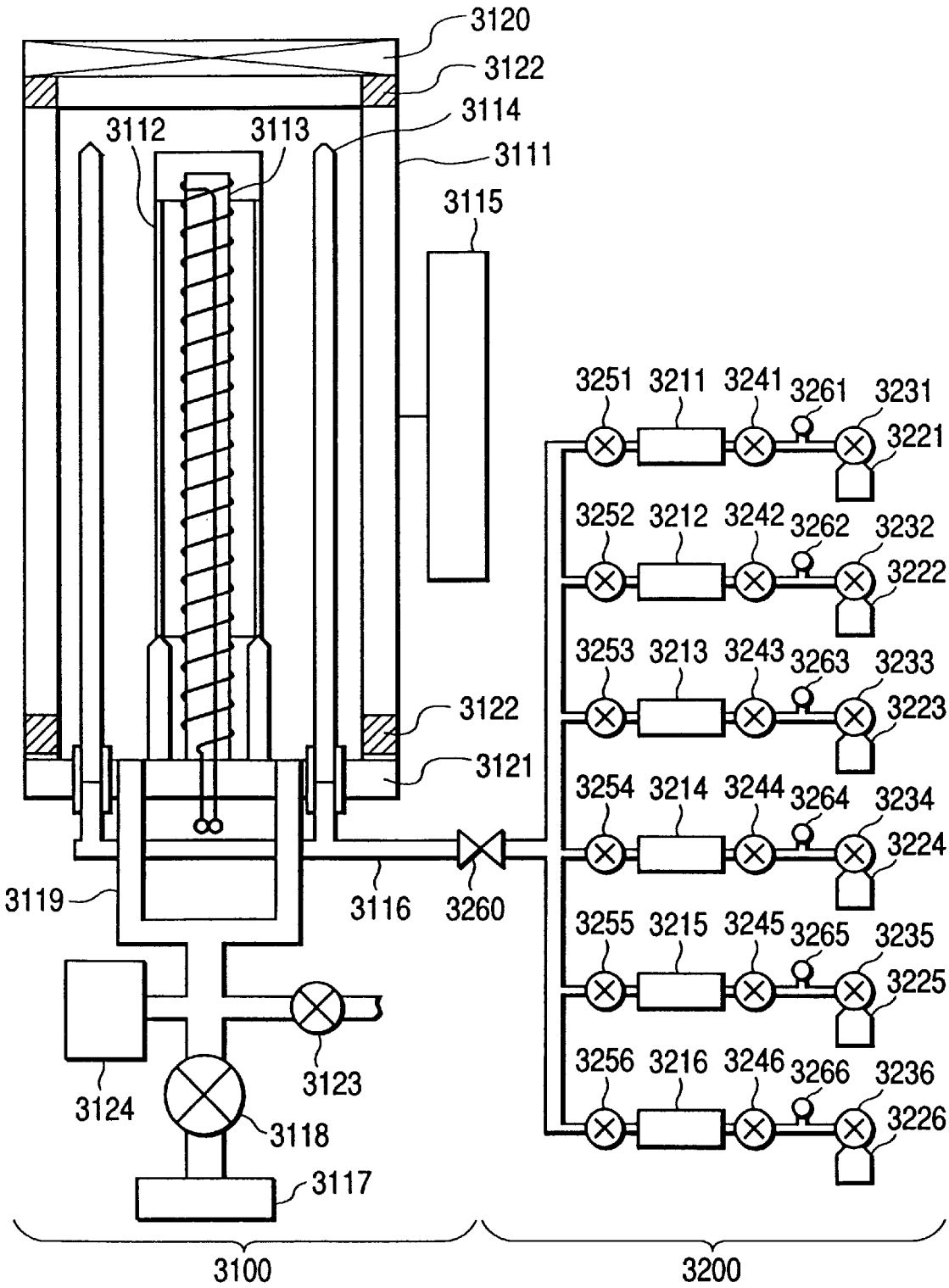
FIG. 3 is a schematic, structural view for explaining an example of a production system for formation of deposited film.

FIG. 3 is a schematic, structural view showing an example of the production apparatus by the RF-CVD method.

In FIG. 3, reference numeral 3100 designates a deposition device and 3200 a gas supply device which supplies the source gases and/or a dilution gas necessary for formation of the deposited film and the like.

A deposition chamber is composed of a wall 3111, a base plate 3121, a gate valve 3120, and an insulator 3122 and has gas inlet pipes 3114 and a heater 3113 for heating the support 3112 in the space inside the chamber. The space inside the deposition chamber is connected via an exhaust valve 3118 to an exhaust pump 3117 by an exhaust pipe 3119. The exhaust pipe has a vacuum gage 3124 and an atmosphere communication valve 3123 between the exhaust valve 3118 and the deposition chamber. Reference numeral 3115 denotes an RF power supply, and the wall 3111 serves as one electrode while the support 3112 as the other electrode in this example.

A gas supply pipe 3116 for the gases supplied from the gas supply device 3200 is connected to the gas inlet pipes 3114. The source gases including the dilution gas are enclosed in respective bombs 3221 to 3226, and they are supplied from valves 3231 to 3236 through inflow valves 3241 to 3246, mass flow controllers 3211 to 3216, and outflow valves 3251 to 3256 and through a connection valve 3260 to the deposition device side. Reference numerals 3261 to 3266 represent pressure regulators.

Next described is an example of the method for producing the electrophotographic, photosensitive member for electrophotography formed by the high-frequency plasma CVD (VHF-PCVD method) process using the frequency in the VHF band.

Figure 4:
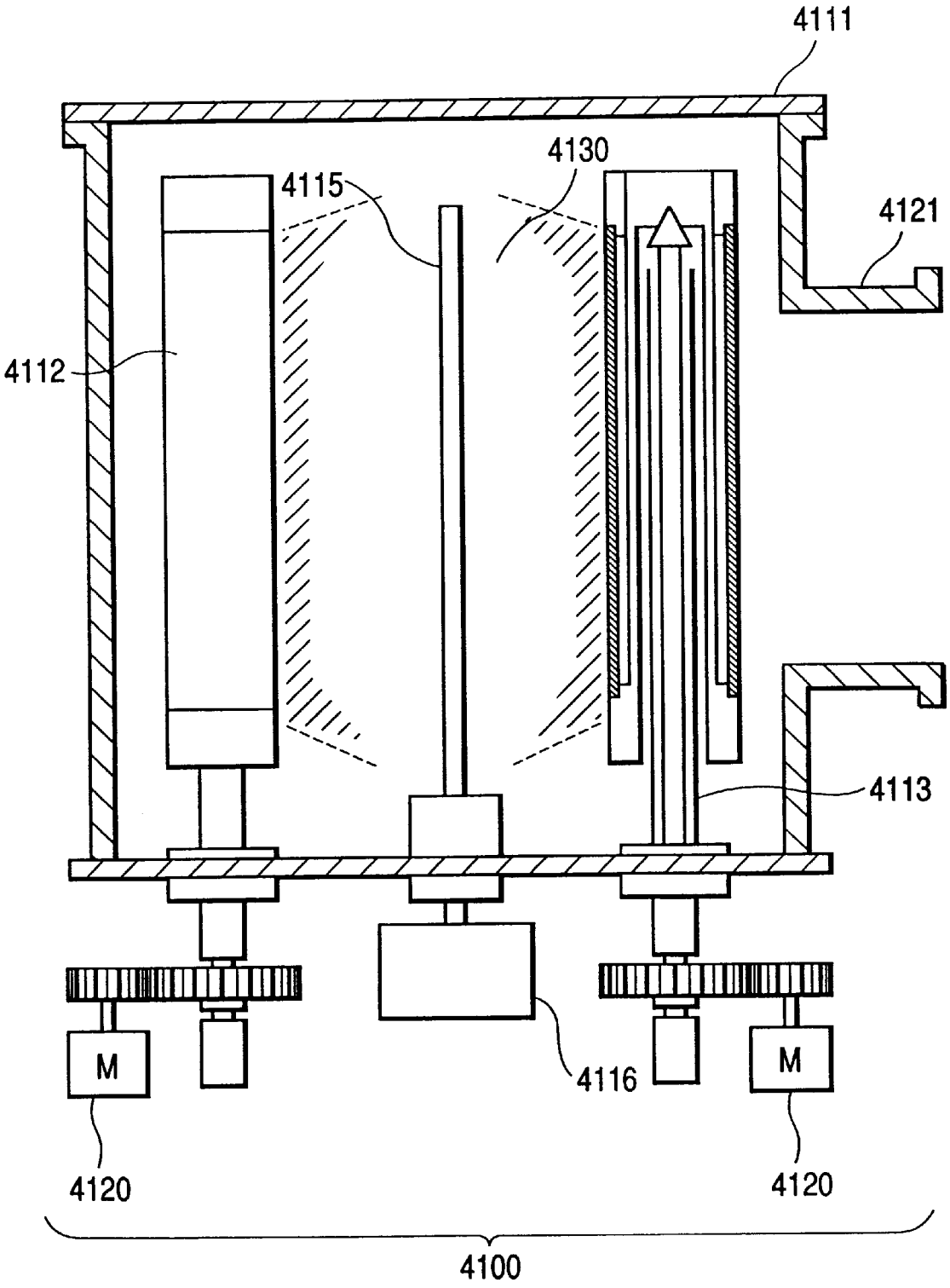
FIG. 4 is a schematic, structural view for explaining an example of a deposition system.

An apparatus for producing the electrophotographic, photosensitive member for electrophotography by the VHF-PCVD process can be constructed by connecting the deposition device illustrated in FIG. 4, instead of the deposition device by the RF-PCVD method in the production apparatus shown in FIG. 3, to the source gas supply device (3200).

This apparatus is generally constructed of a depressurizable reaction vessel 4111 of the vacuum hermetic structure, the source gas supplying device 3200, and an evacuation system (not illustrated) for depressurizing the inside of the reaction vessel 4111. Inside the reaction vessel 4111 there are provided electroconductive supports 4112, heaters 4113 for heating the supports, source gas inlet pipes (not illustrated), and an electrode 4115, and a high-frequency matching box 4116 is further connected to the electrode 4115. The space inside the reaction vessel 4111 is connected to an unrepresented diffusion pump through an exhaust pipe 4121. Numeral 4120 stands for motors for rotating the associated supports 4112.

The source gas supplying device 3200 is constructed of bombs of source gases such as $SiH_4$, $GeH_4$, $H_2$, $CH_4$, $B_2H_6$, $PH_3$. etc., valves, and mass flow controllers, a bomb of each source gas being connected via a valve to the gas inlet pipes (not illustrated) in the reaction vessel 4111. The space surrounded by the conductive supports 4112 creates a discharge space 4130.

Formation of the deposited film in this apparatus by the VHF-PCVD method is carried out as follows.

First, the conductive supports 4112 are set in the reaction vessel 4111, the supports 4112 are rotated by the driving units 4120, and the inside of the reaction vessel 4111 is evacuated through the exhaust pipe 4121 by the unrepresented evacuation system (for example, a diffusion pump), thereby adjusting the pressure inside the reaction vessel to not more than $1\times10^{-7}$ Torr. Next, the temperature of the conductive supports 4112 is raised to and maintained at a predetermined temperature in the range of 50° C. to 500° C. by the heaters 4113 for heating the supports.

For letting the source gases for formation of the deposited film into the reaction vessel, after it is confirmed that the valves of the gas bombs and the leak valve (not illustrated) of the reaction vessel are closed and that the inflow valves 3241–3246, the outflow valves 3251–3256, and the auxiliary valve 3260 are opened, the main valve (not illustrated) is first opened to evacuate the inside of the reaction vessel and gas pipes. When the reading of the vacuum gage (not illustrated) then reaches about $5\times10^{-6}$ Torr, the auxiliary valve and outflow valves are closed.

After that, each gas is introduced from the corresponding gas bomb with opening the associated valve and the pressure of each gas is regulated to 2 kg/cm$^2$ by the pressure regulator 3261–3266. Then the inflow valve is gradually opened to introduce each gas into the mass flow controller.

After completion of the preparation for deposition as described above, formation of each layer is carried out.

When the conductive supports reach the predetermined temperature, necessary valves out of the outflow valves and the auxiliary valve are gradually opened to introduce prescribed gases from the corresponding gas bombs through the gas inlet pipes (not illustrated) into the discharge space in the reaction vessel. Then the flow of each source gas is adjusted to a predetermined flow rate by the corresponding mass flow controller. On that occasion, the degree of valve opening of the main valve (not illustrated) is adjusted with observing the vacuum gage (not illustrated) so that the pressure inside the discharge space becomes a predetermined pressure of not more than 1 Torr.

Deposition of each layer is carried out as follows. The VHF power supply (not illustrated), for example, of the frequency 500 MHz is set to a desired power, and the VHF power is introduced via the matching box 4116 to the discharge space 4130 to induce glow discharge. In the discharge space 4130 surrounded by the supports 4112, the source gases introduced are thus excited and dissociated by discharge energy, whereby a predetermined deposition film is formed on the supports 4112. At this time, the output of the heaters 4113 for heating the supports is adjusted at the same time as the introduction of the VHF power to change the temperature of the conductive supports 4112 to a desired value. On this occasion, the supports are rotated at a desired rotation rate by the motors 4120 for rotation of the supports in order to uniform the formation of layer.

After completion of formation of the film in a desired film thickness, the supply of the VHF power is terminated and the outflow valves are closed to stop the inflow of the gases into the reaction vessel, thus completing the formation of the desired layer.

The like operation is repeated several times, if necessary, thereby forming the electrophotographic, photosensitive member in desired layer structure.

It is needless to mention that all the other outflow valves than those of the necessary gases are closed in formation of each layer and, in order to prevent each gas from remaining inside the reaction vessel or inside the pipes from the outflow valves to the reaction vessel, an operation for once evacuating the inside of the system to a high vacuum is carried out according to the necessity by closing the outflow valves, opening the auxiliary valve, and fully opening the main valve (not illustrated).

It is needless to mention that the above-stated gas species and valve operations are modified according to the production conditions of each layer.

The heating means for the conductive substrates can be any heat-generating member prepared in a vacuum specification and, more specifically, they can be selected from electric resistance heat-generating members such as winding heaters of sheath heaters, sheet-like heaters, ceramic heaters, and so on, heat-radiating lamp heat-generating members such as halogen lamps, infrared lamps, and so on, heat-generating members by heat exchange means using liquid, gas, or the like as a heat medium, and so on. A material for the surface of the heating means can be selected from metals such as stainless steel, nickel, aluminum, copper, and the like, ceramics, heat-resistant polymers, and so on. In addition thereto, another applicable method is a method in which a vessel dedicated for heating is provided in addition to the reaction vessel, the conductive supports are heated in the dedicated vessel, and thereafter the conductive supports are transferred into the vacuum in the reaction vessel, for example.

It is also desirable to determine the pressure of the discharge space, particularly, in the VHF-PCVD method preferably in the range of not less than 1 mTorr nor more than 500 mTorr, more preferably in the range of not less than 1 mTorr nor more than 300 mTorr, and most preferably in the range of not less than 1 mTorr nor more than 100 mTorr.

The size and shape of the electrode 4115 provided in the discharge space in the VHF-PCVD method can be any size and shape as long as they do not disorder the discharge, but a preferred electrode is a cylindrical one having the diameter of not less than 1 mm nor more than 10 cm in practical use. At this time, the length of the electrode can also be set to an arbitrary value as long as it is such a length as to realize uniform application of the electric field to the conductive supports.

The material for the electrode 4115 can be any material as long as the surface is electrically conductive. The material is normally selected, for example, from metals such as stainless steel, Al, Cr, Mo, Au, In, Nb, Te, V, Ti, Pt, Pb, Fe, and so on, alloys thereof, glasses or ceramics with a surface undergoing an electroconductive treatment, and so on.

The electrophotographic, photosensitive member produced by the method of the present invention can be used not only in the electrophotographic copiers, but also in applications of electrophotography, including laser beam printers, CRT printers, LED printers, liquid crystal printers, laser engraving machines, and so on.

Next described is the electrophotographic apparatus incorporating the photosensitive member of the present invention.

<Electrophotographic apparatus>

It is known heretofore that in the electrophotographic apparatus making use of the corona charging, ozone products are attached to the surface of the photosensitive member to cause image unfocussing, particularly, at high humidity. In the case of the photoconductive members having the surface relatively easy to wear like organic photoconductors (OPCs), it is easy to wear and remove the ozone products etc. formed on the surface by a polishing means or the like, but the polishing effect, if too high, will degrade the function as a photosensitive member to shorten the lifetime. In the case of the surface insulating layer of the CdS photosensitive member used in the amorphous photosensitive members (hereinafter referred to as a-Si photosensitive members) or in the NP method, the surface layer is very hard and the ozone oxides etc. formed on the surface are resistant to wear and removal in certain cases.

It is thus the practice to provide a heater inside and near the photosensitive member to heat the surface of the photosensitive member to the temperature of about 35 to 45° C. This heating of the photosensitive member is carried out for various purposes, but a principal purpose is to prevent and remove the image unfocussing occurring at high humidity. This is for the following reason. The ozone evolving in the corona charger chemically deteriorates the surface of the photosensitive member to make the hydrophilic groups (—OH etc.) and the like, and the surface becomes apt to absorb moisture. This causes a phenomenon of lateral flow of surface potential which is fatal to electrophotography. Therefore, the surface is heated to remove water. Since the substances of $NO_x$ etc. produced by ozone attach to the surface of the photosensitive member and absorb moisture similarly, the principal purpose is to heat the surface to remove water similarly.

The heating means can be a hot air blow or the like, but the dominating heating means is heating with an electric heater from the inside of the photosensitive member. It was the conventional practice to employ a temperature-controlling method with a rod heater disposed in a shaft for supporting the photosensitive member, as a rotational shaft of the photosensitive member, but it is recently common practice, particularly in the a-Si photosensitive members, to employ a method of placing a sheet-like heater on the inside surface of the photosensitive member in order to enhance the temperature control accuracy for control of the surface temperature of the photosensitive member and eliminate temperature irregularities across the entire surface of the photosensitive member.

The conventional heating means will be described specifically.

Figure 5A:
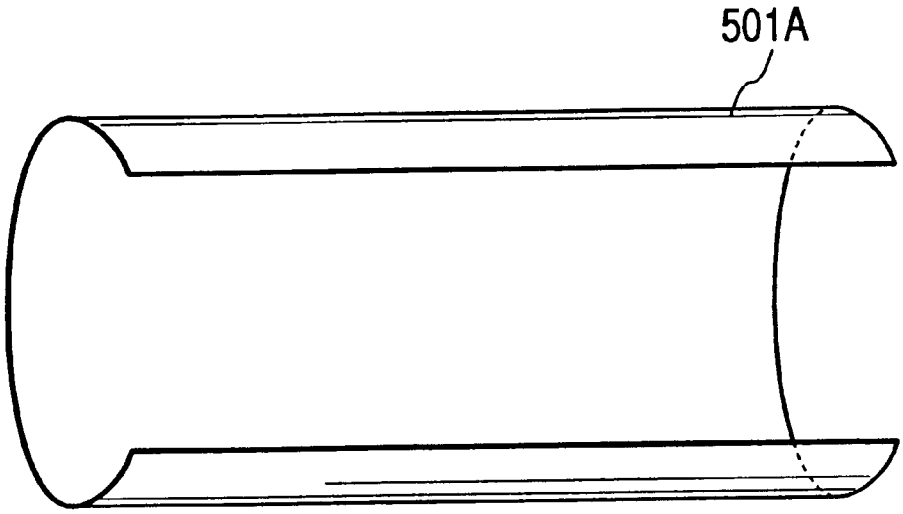
FIG. 5A is a schematic, perspective view showing an example of a heater
Figure 5B:
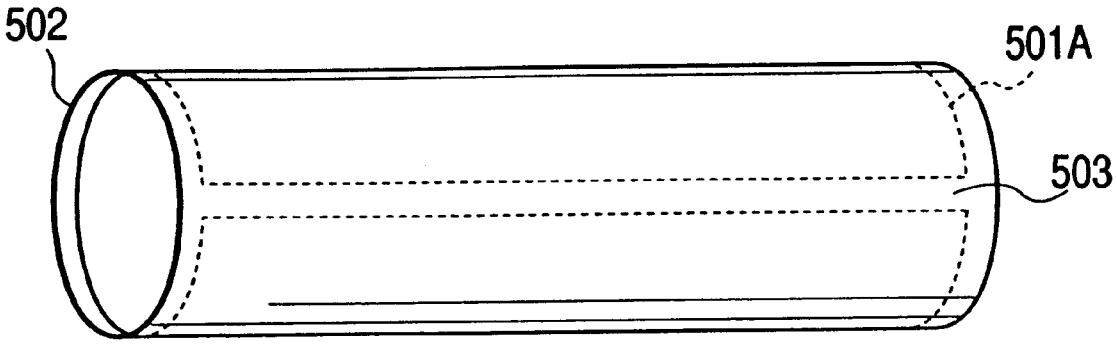
FIG. 5B is a schematic, perspective view showing an example of application of the heater of FIG. 5A to a photosensitive member.

FIG. 5A is a schematic, perspective view showing a curved state of a flat sheet heater 501A for the photosensitive member before mounted and FIG. 5B is a schematic, perspective view showing a state in which the flat sheet heater 501A for the photosensitive member is mounted with a clearance 503 inside the drum of the photosensitive member. There are commonly used heaters for the photosensitive member, which are generally classified under the rod-like type in which the heater is disposed without contact with the inside surface of the photosensitive member, which is not illustrated, and the sheet-like type in which the heater is in contact with the inside surface of the photosensitive member, as in the figure. The latter sheet-like type has higher temperature control accuracy.

Figure 6:
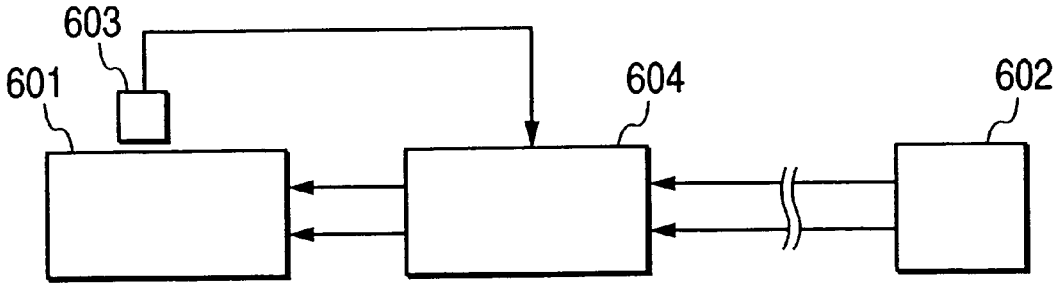
FIG. 6 is a schematic block diagram showing an example of a temperature regulating mechanism of the heater.
Figure 7:
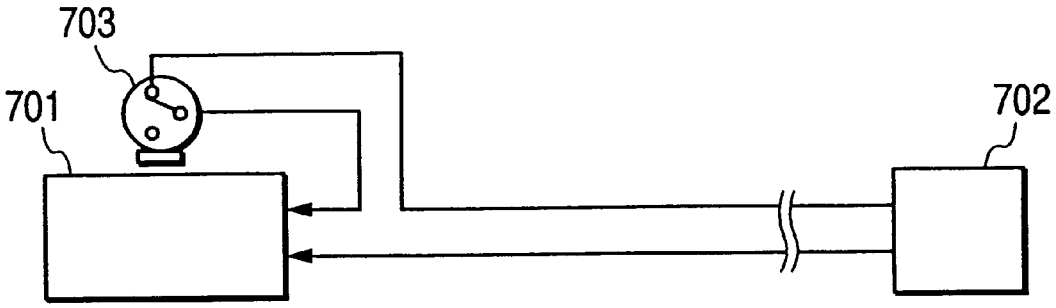
FIG. 7 is a schematic block diagram showing an example of another temperature regulating mechanism of the heater.

FIG. 6 and FIG. 7 show examples of blocks for control of temperature.

In FIG. 6, reference numeral 601 designates a heater for photosensitive member, 602 an AC power supply for supply of power, 603 a thermistor for temperature feedback, and 604 a control circuit for controlling switching of on/off or several steps of power supply to the heater according to the resistance of the thermistor 603. Wave lines in the figure indicate the border between the main body of the electrophotographic apparatus and the photosensitive member unit, which normally contact with each other through a slip ring or the like. Since the thermistor 603 has such a property as to turn into a low resistance at high temperature, the temperature is fed back to the control circuit to effect the temperature control.

In FIG. 7, reference numeral 701 designates a heater for the photosensitive member, 702 an AC power supply for supply of power, and 703 a thermoswitch for control of temperature. Wave lines in the figure indicate the border between the main body of the electrophotographic apparatus and the photosensitive member unit, which normally contact with each other through a slip ring or the like. The thermoswitch 703 is connected so as to become off at high temperature, thereby effecting the temperature control. The temperature for off of the thermoswitch is a specific property of the thermoswitch.

The control with the thermistor as illustrated in FIG. 6 permits higher temperature control accuracy because of the structure. Particularly, in the case of the a-Si photosensitive members, the potentials have the temperature dependence of 1 to 6 V/deg as to the dark area potential (300 to 500 V) and the temperature dependence of 1 to 3 V/deg as to the light area potential (50 to 200 V) and thus the accuracy of about ±1° C. is sometimes required for the control of the heating temperature. In this case the configuration of FIG. 6 is more preferred.

This accuracy is implemented with the photosensitive member alone or in a static state in which the photosensitive member is in quiescent operation even if set in the electrophotographic apparatus, but the temperature of the photosensitive member is greatly influenced by the room temperature and the copy mode in a dynamic state, i.e., in a state of sheet pass as actually used in the electrophotographic apparatus. Namely, a quantity of heat transferred from the photosensitive member to the sheet during the sheet pass affects the temperature of sheet and the temperature of the sheet is affected by the room temperature and the copy mode (i.e., whether the sheet about to be used for copy is a sheet newly supplied from the outside of the electrophotographic apparatus or a sheet after pass through a fixing device as in the case of double-side copy, multiple copy, or the like). Since the quantity of heat transferred from the photosensitive member to the sheet is also affected by the frequency of contact between the sheet and the photosensitive member, the influence of the copy mode (whether single side or double side, the set number of copies, the sheet size [size and thickness], etc.) is significant. In order to control the temperature of the photosensitive member at a constant value in the dynamic state, it is thus necessary to supply a much higher power than for the temperature equilibrium state to the heater, so as to increase the response.

When the power supply is increased, the conventional methods, however, could suffer temperature unevenness for the two reasons below in certain cases.

The first reason is the issue of the shape. In the case of the method in which the flat sheet heater is curved so as to be in close fit to the inside surface of the cylindrical, photosensitive member, the temperature response is poor at the seam part of the heater and there sometimes arises a temperature difference between the seam part and the heater part. One method for overcoming it is use of a seamless heater.

The second reason is the issue of the control method. In the case of the control method to effect switching with the circuit using the thermistor, though depending upon the temperature detection position and the control circuit, there is such a general tendency that overshoots and temperature control ripples increase with increase of power. In order to reduce them, the control circuit became expensive and the temperature unevenness had to be conceded to some extent, taking practical cost into consideration.

It is then conceivable to employ a PTC (positive temperature coefficient) heater (self-temperature-control heater) whose resistance has a temperature dependence. The PTC heater is a heater utilizing such a property of the resistor itself as to increase the resistance at high temperature and being capable of controlling the temperature of the resistor so as to be constant. Therefore, the PTC heater needs no temperature control circuit and theoretically suffers no overshoots or ripples.

The PTC heater is a heater self-controlled at an appropriate temperature because of the PTC characteristics of the PTC resistor between electrodes. An example of the known PTC heater is a sheet-like heat-generating member in which a heat-generator layer and electrodes are laminated through a thermoadhesive resin with respect to an insulating layer of a film shape by a laminating device or by heating and pressing to bond them into an integral form. There are various configurations depending upon the needs such as high temperature, high power, and so on, including the configurations composed of a pair of electrodes as described in Japanese Patent Publications No. 57-43995 and No. 55-40161, and their fundamental structure is substantially the same.

It is, therefore, considered that use of the PTC heater in the seamless structure is extremely effective means in the electrophotographic apparatus that has to be controlled with large power, as described previously.

As described above, the drum-like metal substrate can be formed in the thickness of not less than 0.1 mm but less than 2.5 mm, whereby the production cost can be curtailed drastically.

When the heater is used in the drum-like metal substrate having the thickness of not less than 0.1 mm but less than 2.5 mm, the temperature control can be achieved with high accuracy, because the temperature gradient is small between the heater and the surface of the photosensitive member.

Further, because the use of the PTC heater in the seamless structure permits input of much higher power than for the temperature equilibrium state, the response is increased to make quick temperature increase possible and the temperature control can be performed without the overshoots nor the temperature-control ripples even in the dynamic state with sheet pass.

When the drum-like metal substrate used is one having the outside diameter not less than 20 mm nor more than 60 mm, the degree of thermal deformation of the drum-like metal substrate can be suppressed to a sufficiently small level even if the drum-like metal substrate is heated during production of the photoconductive member and during use as a photosensitive drum for electrophotography. Therefore, the degree of film peeling off of the a-Si(H,X) deposited film can be controlled to a level in which no problem is posed in the practical use, or to zero. In addition, the thickness of the drum-like metal substrate can be made not less than 0.1 mm but less than 2.5 mm, whereby the production cost can be curtailed drastically.

Figure 13:
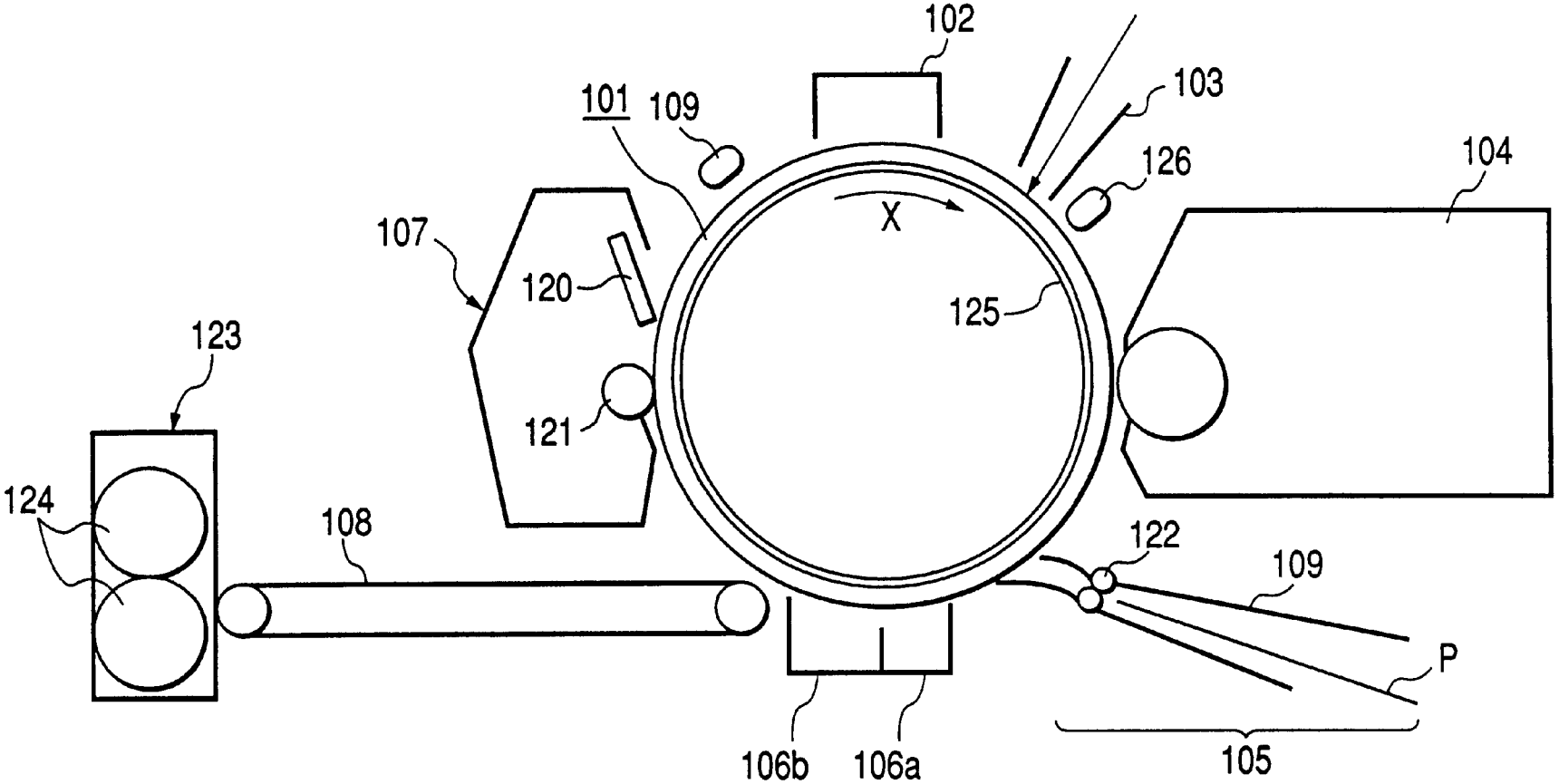
FIG. 13 is a schematic, structural view showing an example of the image forming apparatus.

FIG. 13 is a schematic view of image forming apparatus for explaining an example of the image forming apparatus.

Around the photosensitive member 101 for the image forming apparatus utilizing the electrophotographic method (hereinafter referred to simply as "photosensitive member"), which rotates in the direction of arrow X, there are a primary charger 102, an electrostatic latent image forming section 103, a developing unit 104, a transfer sheet supply system 105, a transfer charger 106*a*, a separation charger 106*b*, a cleaner 107, a conveying system 108, a charge-eliminating light source 109, etc., which are disposed in the stated order clockwise in the figure. The photosensitive member 101 may be subjected to the temperature control with a sheet-like inside heater 125 as occasion demands.

The photosensitive member 101 is uniformly charged in the surface thereof with the primary charger 102 and is exposed to light according to the necessity at the electrostatic latent image forming section 103 to form an electrostatic latent image thereon.

This electrostatic latent image is developed into a toner image by a developing sleeve of the developing unit 104 coated with a developer (toner).

On the other hand, a transfer sheet P is supplied while guided by transfer sheet guide 119 of the transfer sheet supply system 105 and adjusted at the tip by registration rollers 122, and the toner image formed on the surface of the photosensitive member 101 is transferred onto the transfer sheet P with the transfer charger 106*a*. The transfer sheet P is separated from the photosensitive member 101 by the separation charger 106*b* and/or a separating means such as a claw (not illustrated) or the like. The transfer sheet is conveyed via the conveying system 108 into a fixing device 123 and the toner image on the surface thereof is fixed by fixing rollers 124 in the fixing unit 123. After that, the transfer sheet is discharged out of the image forming apparatus.

On the other hand, the surface of the photosensitive member 101 after the transfer of the toner image is processed by removing attached substances such as the residual toner, paper powder, etc. from the surface by a cleaning blade 120, a cleaning roller (or brush) 121 or the like in the cleaning device 107, and is then subjected to the next image formation.

EXAMPLES

The present invention will be described in further detail with examples thereof, but it is noted that the present invention is by no means intended to be limited to these examples.

Example 1

Figure 2:
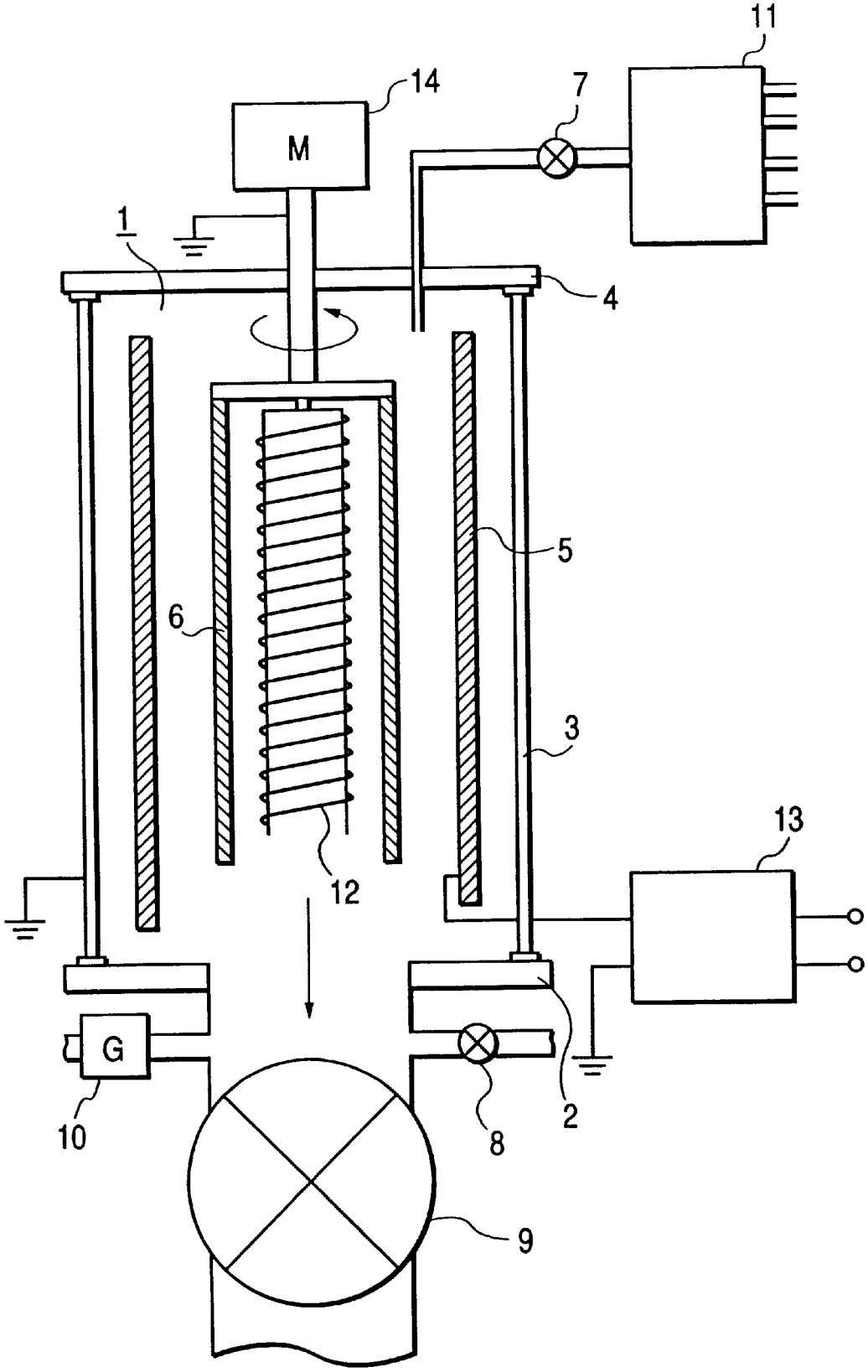
FIG. 2 is a schematic, structural view for explaining an example of a deposition system.

Using the production system of the photoconductive member for electrophotography illustrated in FIG. 2, the a-Si:H deposited film was formed under the below conditions on each of drum-like substrates of aluminum respectively having different outside diameters of 10 mm, 20 mm, 30 mm, 60 mm, 80 mm, and 108 mm and different thicknesses of 0.05 mm, 0.10 mm, 0.50 mm, 1.00 mm, 1.50 mm, 2.00 mm, 2.50 mm, 3.00 mm, 3.50 mm, and 5.00 mm, according to the glow discharge decomposition method detailed previously.

Temperature of drum-like substrate: 250° C.

Internal pressure inside the deposition chamber during formation of deposited film: 0.03 Torr Discharge frequency: 13.56 MHz Forming rate of deposited film: 20 Å/sec Discharge power: 0.18 W/cm$^2$ Thickness: 20 $\mu$m The states of film peeling off of the electrophotographic, photosensitive drums thus obtained were observed and thereafter each of these photosensitive drums was set in a copying machine for tests modified for the tests to perform formation of image. The images were evaluated in order to indicate the influence of the film peeling off. The results are shown in Table 1.

TABLE 1

| | | Outside diameter | | | | | |
|---|---|---|---|---|---|---|---|
| Film peeling off | | 10 | 20 | 30 | 60 | 80 | 108 |
| Thickness | 0.05 | — | — | — | — | — | — |
| | 0.10 | ○ | ○ | Δ | Δ | x | x |
| | 0.50 | ○ | ○ | ○ | Δ | x | x |
| | 1.00 | ◎ | ○ | ○ | Δ | x | x |
| | 1.50 | ◎ | ◎ | ○ | ○ | Δ | x |
| | 2.00 | ◎ | ◎ | ◎ | ○ | Δ | x |
| | 2.50 | ◎ | ◎ | ◎ | ◎ | ○ | Δ |
| | 3.00 | ◎ | ◎ | ◎ | ◎ | ◎ | ○ |
| | 3.50 | ◎ | ◎ | ◎ | ◎ | ◎ | ○ |
| | 5.00 | ◎ | ◎ | ◎ | ◎ | ◎ | ◎ |

Criteria for evaluation:
◎ very good,
○ good,
Δ practically acceptable,
x possibly problematic in practical use,
— unmeasurable Criteria for evaluation: ◎ very good, ○ good, Δ practically acceptable, x possibly problematic in practical use, —unmeasurable The photosensitive drums of the substrate 0.05 mm thick suffered film peeling off during the deposition or during the measurement because of their insufficient strength and the measurement was impossible therewith.

It was confirmed that the film peeling off tended to decrease with increasing thickness. On the other hand, it was a new finding that the film peeling off tended to decrease with decreasing outside diameter.

Using the photosensitive drums of the outside diameter of 80 mm and 108 mm, the roundness was measured for the photosensitive drums of the thickness of 1.5 mm and 2.0 mm, and there was a difference of approximately 100 $\mu$m between the most depressed part and the most projecting part. In the case of the photosensitive drums of the thickness of 2.5 mm and 3.0 mm and the photosensitive drums of the outside diameter of 30 mm and 60 mm, the difference was about 30 $\mu$m. In the case of the photosensitive drums of the thickness of 3.5 mm and 5.0 mm, the difference was 10 to 20 $\mu$m. The evaluation results of roundness are shown in Table 2.

TABLE 2

| | | Outside diameter | | | | | |
|---|---|---|---|---|---|---|---|
| Roundness | | 10 | 20 | 30 | 60 | 80 | 108 |
| Thickness | 0.05 | — | — | — | — | — | — |
| | 0.10 | ○ | ○ | Δ | Δ | x | x |
| | 0.50 | ○ | ○ | ○ | Δ | x | x |
| | 1.00 | ◎ | ○ | ○ | Δ | Δ | x |
| | 1.50 | ◎ | ◎ | ○ | ○ | Δ | x |
| | 2.00 | ◎ | ◎ | ◎ | ○ | ○ | x |
| | 2.50 | ◎ | ◎ | ◎ | ◎ | ○ | Δ |
| | 3.00 | ◎ | ◎ | ◎ | ◎ | ◎ | ○ |
| | 3.50 | ◎ | ◎ | ◎ | ◎ | ◎ | ◎ |
| | 5.00 | ◎ | ◎ | ◎ | ◎ | ◎ | ◎ |

Criteria for evaluation:
◎ very good,
○ good,
Δ practically acceptable,
x possibly problematic in practical use,
— unmeasurable Criteria for evaluation: ◎ very good, ○ good, Δ practically acceptable, x possibly problematic in practical use, —unmeasurable With the photosensitive members of the thin conductive substrate less than 2.5 mm, film peeling off levels of those having the outside diameter not more than 60 mm were substantially equivalent to those of the photosensitive members of the thick photoconductive substrate not less than 2.5 mm.

Example 2

Figure 8A:
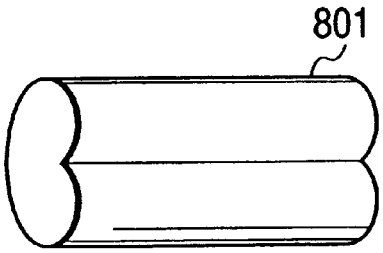
FIG. 8A and 8B are schematic, perspective views showing an example of a PTC heater.
Figure 8B:
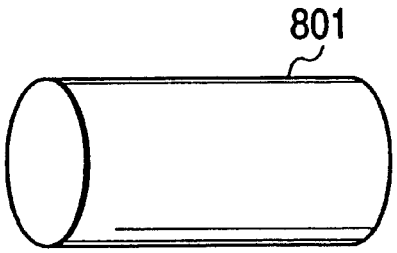
Figure 9:
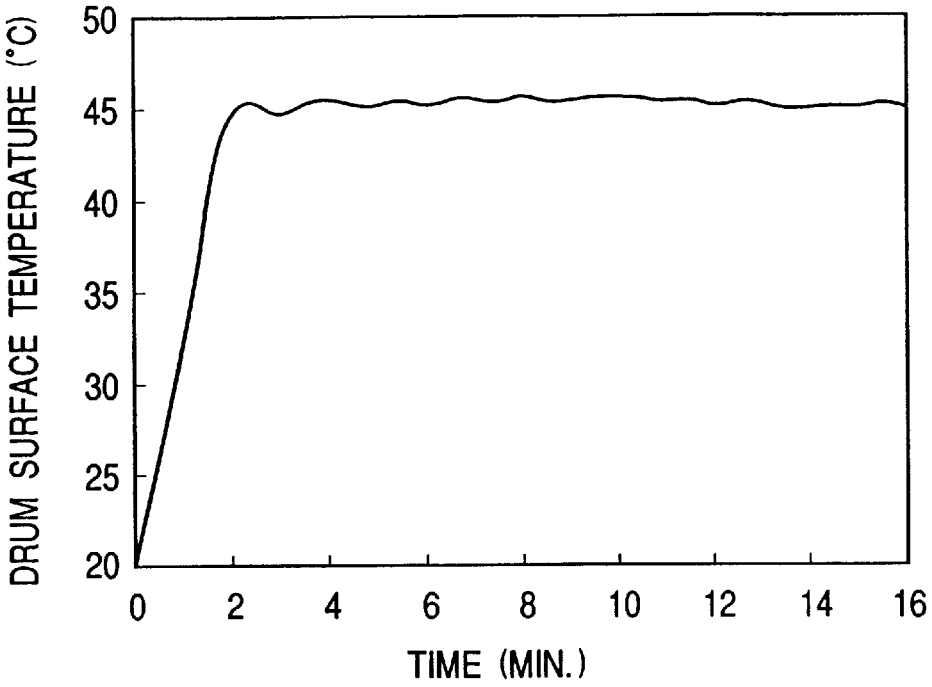
FIG. 9 is a graph showing an example of surface temperature of the photosensitive member in a quiescent state (a static state)

Using the PTC heater of a seamless cylinder shape and a flexible type to be set in close fit to the inside surface of the photosensitive member, as illustrated in FIGS. 8A and 8B, without use of the temperature control circuit, several types of photosensitive members having different thicknesses of the conductive substrate and different outside diameters of the cylinder were prepared and set in the test machine. Then the heater was activated with the optimum power according to the heat capacity of the photosensitive member and time changes of temperature were measured in a static state in which the temperature of the photosensitive member was controlled to 45° C., after the start of power supply to the heater. FIG. 9 shows an example of the results of the measurement. The determination results are shown in Table 3.

TABLE 3

| Static test (PTC) | | Outside diameter 10 | 20 | 30 | 60 | 80 | 108 |
|---|---|---|---|---|---|---|---|
| Thickness | 0.05 | — | — | — | — | — | — |
| | 0.10 | — | ◎ | ◎ | ◎ | ◎ | ◎ |
| | 0.50 | — | ◎ | ◎ | ◎ | ◎ | ◎ |
| | 1.00 | — | ◎ | ◎ | ◎ | ◎ | ◎ |
| | 1.50 | — | ◎ | ◎ | ◎ | ◎ | ◎ |
| | 2.00 | — | ◎ | ◎ | ◎ | ◎ | ◎ |
| | 2.50 | — | ○ | ○ | ○ | ○ | ○ |
| | 3.00 | — | ○ | ○ | ○ | ○ | ○ |
| | 3.50 | — | ○ | ○ | ○ | ○ | ○ |
| | 5.00 | — | ○ | ○ | ○ | ○ | ○ |

Criteria for evaluation:
◎ very good,
○ good,
— unmeasurable

Criteria for evaluation: ◎ very good, ○ good, —unmeasurable

The photosensitive drums of the substrate 0.05 mm thick suffered film peeling off during the deposition or during the measurement because of their insufficient strength and the measurement was impossible therewith.

FIG. 8A shows a shape of the heater for the photosensitive member before mounted and FIG. 8B shows a shape of the heater for the photosensitive member after mounted. During detachment or attachment, part of the heater is deformed, as illustrated in FIG. 8A, so as to decrease the substantial outside diameter. When mounted in the photosensitive member, the heater returns into the cylindrical shape by its restoring force so as to go into close fit to the inside surface of the photosensitive member. In order to realize it, the outside diameter of the heater is set equal to the inside diameter of the photosensitive member.

A typical example of the actual measurement is as shown in FIG. 9. Almost the same tendency was observed at all measured portions on the photosensitive member. When the temperature was increased quickly with large power, there appeared no temperature difference depending upon locations upon switching nor time changes (temperature control ripples) of temperature at the measured portions.

As shown in Table 3, the good results were obtained for all the samples with little dependence on the outside diameter by using the optimum power according to the heat capacity of the photosensitive member. The results were better, particularly, with the samples of the thickness less than 2.5 mm.

Comparative Example 1

Figure 10:
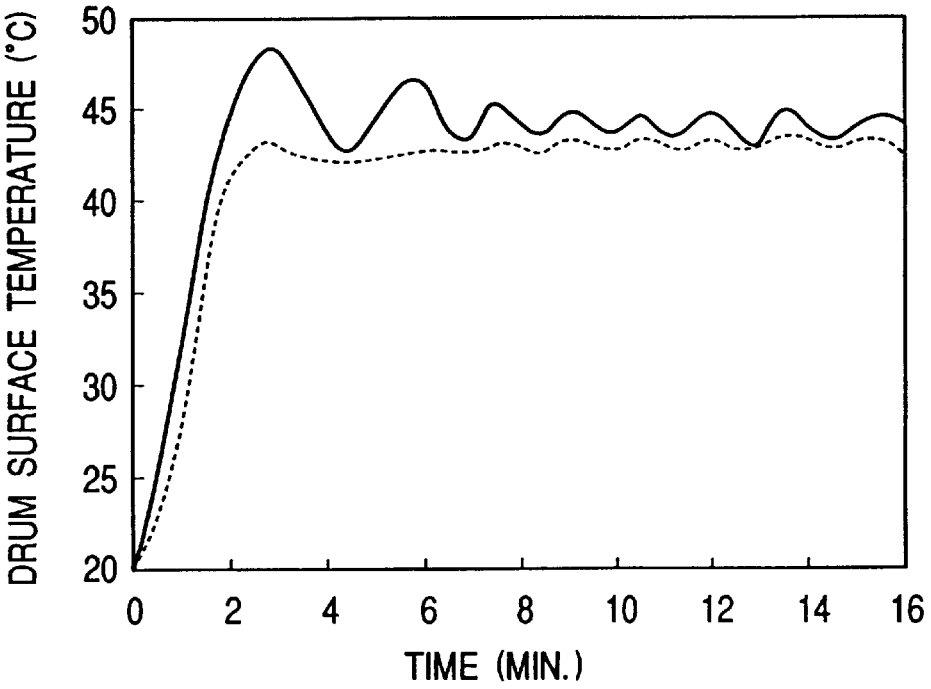
FIG. 10 is a graph showing an example of surface temperature of the photosensitive member in a quiescent state (a static state)

Using the temperature control circuit as illustrated in FIG. 6 and also using the heater of the type with a seam in which the flat sheet heater was curved so as to closely fit the inside surface of the photosensitive member, as illustrated in FIGS. 5A and 5B, and the heater of the seamless cylinder shape and of the flexible type to closely fit the inside surface of the photosensitive member, several types of photosensitive members having different thicknesses of the conductive substrate and different outside diameters of the cylinder were prepared and set in the test machine. Then the heater was activated with the power of Example 2 according to the heat capacity of the photosensitive member and time changes of temperature were measured in a static state in which the temperature of the photosensitive members was controlled to 45° C., after the start of power supply to the heater. FIG. 10 shows an example of the results of the measurement. The determination results are shown in Table 4.

TABLE 4

| Static test (conventional) | | Outside diameter 10 | 20 | 30 | 60 | 80 | 108 |
|---|---|---|---|---|---|---|---|
| Thickness | 0.05 | — | — | — | — | — | — |
| | 0.10 | — | ◎ | ◎ | ◎ | ◎ | ◎ |
| | 0.50 | — | ◎ | ◎ | ◎ | ◎ | ◎ |
| | 1.00 | — | ◎ | ◎ | ◎ | ◎ | ◎ |
| | 1.50 | — | ○ | ○ | ○ | ○ | ○ |
| | 2.00 | — | ○ | ○ | ○ | ○ | ○ |
| | 2.50 | — | ○ | ○ | ○ | ○ | ○ |
| | 3.00 | — | Δ | Δ | Δ | Δ | Δ |
| | 3.50 | — | Δ | Δ | Δ | Δ | Δ |
| | 5.00 | — | Δ | Δ | Δ | Δ | Δ |

Criteria for evaluation:
◎ very good,
○ good,
Δ practically acceptable,
— unmeasurable Criteria for evaluation: ◎ very good, ○ good, Δ practically acceptable, —unmeasurable The photosensitive drums of the substrate 0.05 mm thick suffered film peeling off during the deposition or during the measurement because of their insufficient strength and the measurement was impossible therewith.

In FIG. 10, in the case of the heater of the type with the seam, the temperature changes were as indicated by the solid line at a portion which was not the seam of the heater and as indicated by the dashed line at the seam portion of the heater. There was thus a large temperature difference between them upon switching. On the other hand, in the case of the heater of the type without the seam, the temperature changes were as indicated by the solid line at all the measured portions, and there was no temperature difference depending upon locations upon switching. However, there appeared time changes of temperature (temperature control ripples) at the measured portions.

Even with the heaters of these types which posed no practical problem under the conventional, practical use conditions, the tendencies as described above became more prominent, particularly, with the thick samples, as shown in Table 4, when the temperature was increased quickly with large power.

Example 3

Figure 11:
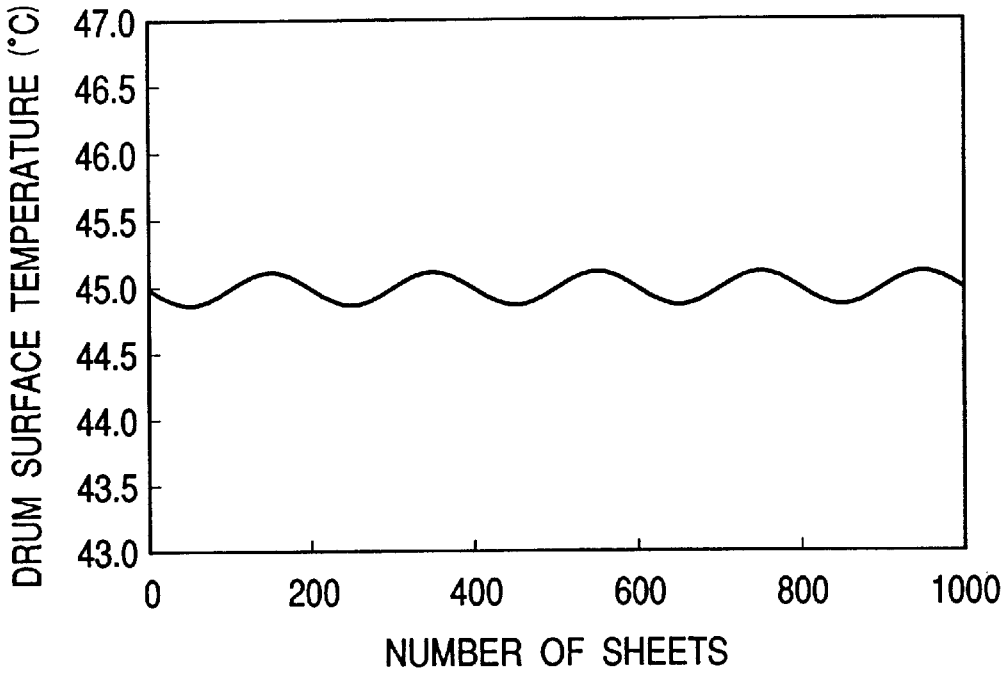
FIG. 11 is a graph showing an example of surface temperature of the photosensitive member in a sheet pass state (a dynamic state)

Using the PTC heater of the seamless cylinder shape and the flexible type to be set in close fit to the inside surface of the photosensitive member, as illustrated in FIGS. 8A and 8B, without use of the temperature control circuit, several types of photosensitive members having different thicknesses of the conductive substrate and different outside diameters of the cylinder were prepared and set in the test machine. Then the heater was activated with the optimum power according to the heat capacity of the photosensitive member, the temperature of the photosensitive member was controlled to 45° C., and time changes of temperature were measured during a continuous sheet pass operation under an ambient at 15° C. The results are shown in FIG. 11 and the measurement results are shown in Table 5.

TABLE 5

| Dynamic test (PTC) | | Outside diameter 10 | 20 | 30 | 60 | 80 | 108 |
|---|---|---|---|---|---|---|---|
| Thickness | 0.05 | — | — | — | — | — | — |
| | 0.10 | — | Δ | Δ | ○ | ○ | ○ |
| | 0.50 | — | Δ | ○ | ○ | ○ | ○ |
| | 1.00 | — | ○ | ○ | ○ | ○ | ○ |
| | 1.50 | — | ◎ | ◎ | ◎ | ◎ | ◎ |
| | 2.00 | — | ◎ | ◎ | ◎ | ◎ | ◎ |
| | 2.50 | — | ◎ | ◎ | ◎ | ◎ | ◎ |
| | 3.00 | — | ◎ | ◎ | ◎ | ◎ | ◎ |
| | 3.50 | — | ◎ | ◎ | ◎ | ◎ | ◎ |
| | 5.00 | — | ◎ | ◎ | ◎ | ◎ | ◎ |

Criteria for evaluation:
◎ very good,
○ good,
Δ practically acceptable,
— unmeasurable Criteria for evaluation: ◎ very good, ○ good, Δ practically acceptable, —unmeasurable The photosensitive drums of the substrate 0.05 mm thick suffered film peeling off during the deposition or during the measurement because of their insufficient strength and the measurement was impossible therewith.

FIG. 11 shows a typical example of the actual measurement and, as shown in Table 5, the good results were obtained for all the samples with little dependence on the outside diameter by using the optimum power according to the heat capacity of the photosensitive member. The results were better, particularly, with the thick samples, because they had a large heat capacity.

When this structure was employed, there appeared no time changes of temperature (or temperature control ripples) even in the dynamic state and no potential unevenness due to the aforementioned temperature characteristics, and the fine image density irregularities, which appeared before during the continuous sheet pass operation, were overcome.

Since the structure was free of the potential unevenness, potential control variations or controlled potential changes due to the potential unevenness caused by temperature characteristics, encountered before, were eliminated in the so-called "potential control" to control latent image conditions by charge quantity, light quantity, etc. with provision of potential measuring means, so as to improve convergence of potential, thereby enhancing stability of image density further.

Comparative Example 2

Figure 12:
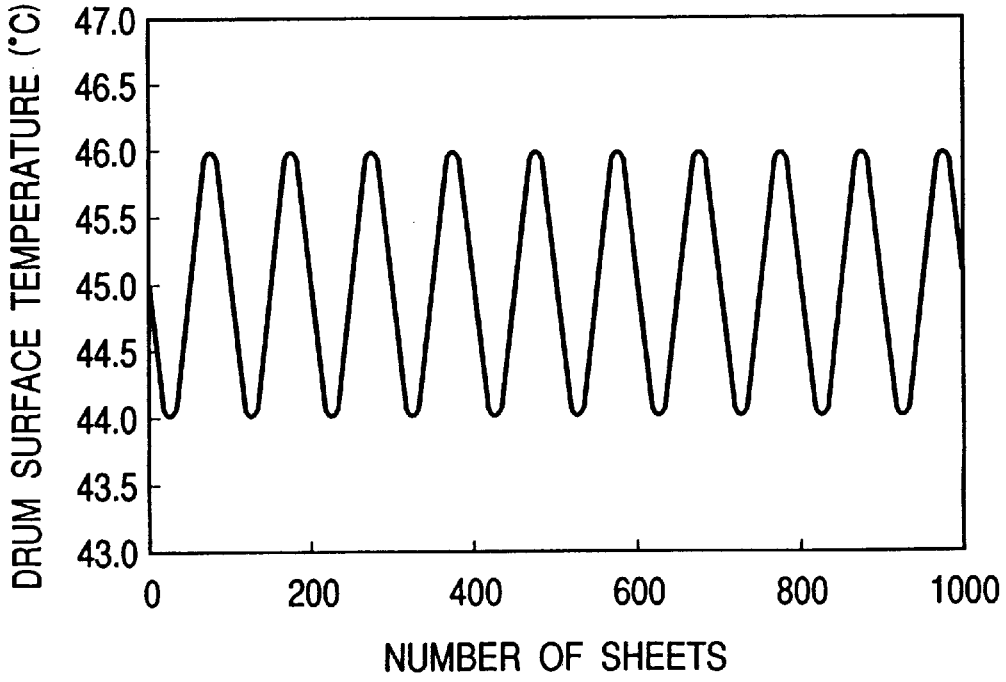
FIG. 12 is a graph showing an example of surface temperature of the photosensitive member in a sheet pass state (a dynamic state)

Using the temperature control circuit as illustrated in FIG. 6 and using a heater of the seamless cylinder shape and the flexible type to be set in close fit to the inside surface of the photosensitive member, several types of photosensitive members having different thicknesses of the conductive substrate and different outside diameters of the cylinder were prepared and set in the test machine. Then the heater was activated with the power of Example 3 according to the heat capacity of the photosensitive member, the temperature of the photosensitive member was controlled to 45° C., and time changes of temperature were measured during the continuous sheet pass operation under an ambient at 15° C. FIG. 12 shows an example of the results of the measurement. The measurement results are shown in Table 6.

TABLE 6

| Dynamic test (conventional) | | Outside diameter 10 | 20 | 30 | 60 | 80 | 108 |
|---|---|---|---|---|---|---|---|
| Thickness | 0.05 | — | — | — | — | — | — |
| | 0.10 | — | x | x | x | x | x |
| | 0.50 | — | x | x | x | x | x |
| | 1.00 | — | x | x | x | x | x |
| | 1.50 | — | Δ | Δ | Δ | Δ | Δ |
| | 2.00 | — | Δ | Δ | Δ | Δ | Δ |
| | 2.50 | — | Δ | Δ | Δ | Δ | Δ |
| | 3.00 | — | ○ | ○ | ○ | ○ | ○ |
| | 3.50 | — | ○ | ○ | ○ | ○ | ○ |
| | 5.00 | — | ○ | ○ | ○ | ○ | ○ |

Criteria for evaluation:
○ good,
Δ practically acceptable,
x possibly problematic in practical use,
— unmeasurable Criteria for evaluation: ◎ good, Δ practically acceptable, x possibly problematic in practical use, —unmeasurable The photosensitive drums of the substrate 0.05 mm thick suffered film peeling off during the deposition or during the measurement because of their insufficient strength and the measurement was impossible therewith.

As illustrated in FIG. 12, because the large power was supplied in order to compensate for the temperature decrease due to the sheet pass, there appeared the temperature control ripples and there also appeared the potential unevenness and image density irregularities due to the aforementioned temperature characteristics.

Example 4

Using the deposited film forming system by the VHF-PCVD method illustrated in FIG. 4, the electrophotographic, photosensitive members of the inhibition type were produced under the conditions of Table 7 according to the aforementioned procedures of the deposited film forming method. The thickness of the photoconductive layer was 20 μm. In the present example, six aluminum supports were prepared in the outside diameter of 80 mm and in the thickness range of 0.1 mm to 2.5 mm, as shown in Table 8. The supports, after cut, were cleaned with pure water and a surface active agent and thereafter rinsed well with pure water. Then they were dried.

TABLE 7

| | Inhibiting layer | Photoconductive layer | Surface protecting layer |
|---|---|---|---|
| Gas species | $SiH_4$: 300 sccm<br>$H_2$: 500 sccm<br>NO: 8 sccm<br>$B_2H_6$: 2000 ppm | $SiH_4$: 500 sccm<br>$H_2$: 500 sccm | $SiH_4$: 50 sccm<br>$CH_4$: 500 sccm |
| Power | 100 W | 400 W | 300 W |
| Inner pressure | 0.018 Torr | 0.020 Torr | 0.020 Torr |
| Thickness | 3.0 μm | 20.0 μm | 0.5 μm |

TABLE 8

| Support | A1 | B1 | C1 | D1 | E1 | F1 |
|---|---|---|---|---|---|---|
| Thickness [mm] | 0.1 | 0.5 | 1.0 | 1.5 | 2.0 | 2.5 |

Each of the photosensitive drums for electrophotography obtained in this way was mounted in the electrophotographic apparatus for tests modified for the tests from NP6750 (trade name) manufactured by CANON K.K. and images were formed thereby. Then the influence of film peeling off was evaluated. The results are shown in Table 9.

Table 10 shows the results of the measurement of roundness of the photosensitive members for electrophotography produced. Numerical values in Table 10 are differences between the most depressed part and the most projecting part.

TABLE 9

| Thickness [mm] | 0.1 | 0.5 | 1.0 | 1.5 | 2.0 | 2.5 |
|---|---|---|---|---|---|---|
| Number of film peeled off portions A | 8 | 6 | 4 | 3 | 1 | 0 |
| Number of film peeled off portions B | 2 | 1 | 0 | 0 | 0 | 0 |
| Evaluation of image | Δ | Δ | ○ | ○ | ◎ | ◎ |

Criteria for image evaluation:
◎ very good,
○ good,
Δ practically acceptable
A: sizes of film peeled off portions 0.3 mm ≦ Φ ≦ 0.6 mm
B: sizes of film peeled off portions 0.6 mm < Φ

Criteria for image evaluation: ◎ very good, ○ good, Δ practically acceptable

A: sizes of film peeled off portions 0.3 mm≦Φ≦0.6 mm

B: sizes of film peeled off portions 0.6 mm<Φ

TABLE 10

| Thickness [mm] | 0.1 | 0.5 | 1.0 | 1.5 | 2.0 | 2.5 |
|---|---|---|---|---|---|---|
| Degree of deformation [μm] | 60 | 35 | 40 | 30 | 10 | 15 |

As seen from Table 9 and Table 10, the film peeling off and the deformation of the support after the deposition were able to be suppressed to the minimum with the photosensitive members for electrophotography prepared by the plasma CVD method to induce the discharge at the discharge frequency not less than 50 MHz nor more than 450 MHz, because the stress of the deposited film was small even in the thickness of the support of not less than 0.1 mm but less than 2.5 mm.

Comparative Example 3

Using the deposited film forming system by the RF-PCVD method illustrated in FIG. 4, the electrophotographic, photosensitive members of the inhibition type were produced under the conditions of Table 11 according to the aforementioned procedures of the deposited film forming method. The thickness of the photoconductive layer was 20 μm. In the present example, six aluminum supports were prepared in the outside diameter of 80 mm and in the thickness range of 0.1 mm to 5.0 mm, as shown in Table 12. The supports, after cut, were cleaned with pure water and the surface active agent and thereafter rinsed well with pure water. Then they were dried.

TABLE 11

| | Inhibiting layer | Photoconductive layer | Surface protecting layer |
|---|---|---|---|
| Gas species | $SiH_4$: 300 sccm<br>$H_2$: 500 sccm<br>NO: 8 sccm<br>$B_2H_6$: 2000 ppm | $SiH_4$: 500 sccm<br>$H_2$: 500 sccm | $SiH_4$: 50 sccm<br>$CH_4$: 500 sccm |
| Power | 100 W | 400 W | 300 W |
| Inner pressure | 0.4 Torr | 0.5 Torr | 0.5 Torr |
| Thickness | 3.0 μm | 20.0 μm | 0.5 μm |

TABLE 12

| Support | A2 | B2 | C2 | D2 | E2 | F2 |
|---|---|---|---|---|---|---|
| Thickness [mm] | 0.1 | 0.5 | 1.5 | 2.5 | 3.0 | 5.0 |

Each of the photosensitive drums for electrophotography obtained in this way was mounted in the electrophotographic apparatus for tests modified for the tests from NP6750 (trade name) of CANON K.K. and images were formed thereby. Then the influence of film peeling off was evaluated. The results are shown in Table 13.

Table 14 shows the results of the measurement of roundness of the photosensitive members for electrophotography produced. Numerical values in Table 14 are differences between the most depressed part and the most projecting part.

TABLE 13

| Thickness [mm] | 0.1 | 0.5 | 1.5 | 2.5 | 3.0 | 5.0 |
|---|---|---|---|---|---|---|
| Number of film peeled off portions A | 50 | 25 | 22 | 5 | 1 | 1 |
| Number of film peeled off portions B | 20 | 7 | 7 | 1 | 0 | 0 |
| Evaluation of image | x | x | x | Δ | ○ | ◎ |

Criteria for image evaluation:
◎ very good,
○ good,
Δ practically acceptable,
x possibly problematic in practical use
A: sizes of film peeled off portions 0.3 mm ≦ Φ ≦ 0.6 mm
B: sizes of film peeled off portions 0.6 mm < Φ

Criteria for image evaluation: ◎ very good, ○ good, Δ practically acceptable, x possibly problematic in practical use A: sizes of film peeled off portions 0.3 mm≦Φ≦0.6 mm B: sizes of film peeled off portions 0.6 mm<Φ

TABLE 14

| Thickness [mm] | 0.1 | 0.5 | 1.5 | 2.5 | 3.0 | 5.0 |
|---|---|---|---|---|---|---|
| Degree of deformation [μm]* | 150 | 230 | 100 | 80 | 10 | 20 |

*A problem could be posed if the degree of deformation is over 60 μm.

*A problem could be posed if the degree of deformation is over 60 μm.

As seen from Table 13 and Table 14, the photosensitive members for electrophotography prepared by the plasma CVD method to induce the discharge at the discharge frequency (13.56 MHz) in the RF band and having the support of the outside diameter of 80 mm suffered the film peeling off/the deformation of the support after the deposition because of the stress in the deposited film unless the thickness of the support was not less than 2.5 mm.

Example 5

Each of the photosensitive members for electrophotography prepared in Example 4 was mounted on the electrophotographic apparatus modified from NP6750 (trade name) of CANON K.K. and was subjected to evaluation of image and evaluation as to surface deviation during the mounted state on the electrophotographic apparatus. The image evaluation was conducted by checking a level of image nonuniformity due to the surface deviation, and image defects. The heater illustrated in FIG. 5A and FIG. 5B and the temperature control circuit were set inside the photosensitive member and controlled so that the temperature of the photosensitive member became 45° C. The results are shown in Table 15.

TABLE 15

| Thickness [mm] | 0.1 | 0.5 | 1.0 | 1.5 | 2.0 | 2.5 |
|---|---|---|---|---|---|---|
| Image defects | Δ | Δ | ○ | ○ | ○ | ◎ |
| Image blur | Δ | ○ | ○ | ○ | ○ | ◎ |
| Image density irregularities | Δ | Δ | ○ | ○ | ○ | ◎ |

Criteria for image evaluation:
◎ very good,
○ good,
Δ practically acceptable

Criteria for image evaluation: ◎ very good, ○ good, Δ practically acceptable

As shown in Table 15, the very good results were obtained in the electrophotographic apparatus incorporating the photosensitive member of the present invention. Namely, it was made possible to obtain the good electrophotographic apparatus with suppressing the film peeling off/the deformation of the support to the minimum even in the thickness of the support not less than 0.1 mm but less than 2.5 mm because of the small stress in film if a-Si was laid by the VHF-PCVD method at the frequency not less than 50 MHz nor more than 450 MHz.

When the drum-like metal substrate used was the one having the thickness not less than 0.1 mm but less than 2.5 mm and when the heater was used for the control of temperature of the photosensitive member, the temperature was able to be controlled with high accuracy, because the temperature gradient was small between the heater and the surface of the photosensitive member, and very good images were able to be obtained with stable density even in the continuous sheet pass operation.

Example 6

Using the PTC heater of the seamless cylinder shape and the flexible type to be set in close fit to the inside surface of the photosensitive member, as illustrated in FIG. 8B, without use of the temperature control circuit, each of the photosensitive members for electrophotography prepared in Example 4 was set in a test machine modified from NP6750 (trade name) manufactured by CANON K.K. Then the heater was activated with the optimum power according to the heat capacity of the photosensitive member and time changes of temperature were measured in the static state in which the temperature of the photosensitive member was controlled to 45° C., after the start of power supply to the heater. The results were time changes as illustrated in FIG. 9, similar to those in Example 2.

A typical example of the actual measurement was the tendency as illustrated in FIG. 9. Almost the same tendency was observed at all measured portions on the photosensitive member. When the temperature was increased quickly with large power, there appeared no temperature difference depending upon locations upon switching nor time changes of temperature (temperature control ripples) at the measured portions. Further, the good results were obtained for all the samples with little dependence on the thickness of the support by using the optimum power according to the heat capacity of the photosensitive member. The results were better, particularly, with the samples of the support having the thickness less than 2.5 mm.

Comparative Example 4

Using the temperature control circuit as illustrated in FIG. 6 and also using the heater of the type with the seam in which the flat sheet heater was curved so as to closely fit the inside surface of the photosensitive member, and the heater of the seamless cylinder shape and of the flexible type to closely fit the inside surface of the photosensitive member, each of the photosensitive members for electrophotography prepared in Example 4 was set in the test machine modified from NP6750 (trade name) manufactured by CANON K.K. Then the heater was activated with the power of Example 6 according to the heat capacity of the photosensitive member and time changes of temperature were measured in the static state in which the temperature of the photosensitive member was controlled to 45° C., after the start of power supply to the heater. The results of the time changes of temperature demonstrated the tendencies as shown in FIG. 10, similar to those in Comparative Example 1.

In FIG. 10, in the case of the heater of the type with the seam, the temperature changes were as indicated by the solid line at a portion which was not the seam of the heater and as indicated by the dashed line at the seam portion of the heater. There was thus a large temperature difference between them upon switching. On the other hand, in the case of the heater of the type without the seam, the temperature changes were as indicated by the solid line at all the measured portions, and there was no temperature difference depending upon locations upon switching. However, there appeared time changes of temperature (temperature control ripples) at the measured portions.

Even with the heaters of these types which posed no practical problem under the conventional, practical use conditions, the tendencies as described above became more prominent, particularly, with the thick samples when the temperature was increased quickly with large power.

Example 7

Using the PTC heater of the seamless cylinder shape and the flexible type to be set in close fit to the inside surface of the photosensitive member, as illustrated in FIG. 8B, without use of the temperature control circuit, each of the photosensitive members for electrophotography prepared in Example 4 were set in the test machine modified from NP6750 (trade name) of CANON K.K. Then the heater was activated with the optimum power according to the heat capacity of the photosensitive member and controlled so that the temperature of the photosensitive member became 45° C., and time changes of temperature was measured in the continuous sheet pass operation under the ambient at 15° C. The results demonstrated the tendency as shown in FIG. 11, similar to that in Example 3.

The photosensitive drums of the support 0.05 mm thick suffered film peeling off during the deposition or during the measurement because of their insufficient strength and the measurement was impossible therewith.

As shown in FIG. 11, the good results were obtained for all the samples by using the optimum power according to the heat capacity of the photosensitive member. The results were better, particularly, with the thick samples, because they have a large heat capacity.

When this structure was employed, there appeared no time changes of temperature (temperature control ripples) even in the dynamic state and no potential unevenness due to the aforementioned temperature characteristics, and the fine image density irregularities, which appeared before during the continuous sheet pass operation, were overcome.

Since the structure was free of the potential unevenness, potential control variations or controlled potential changes due to the potential unevenness caused by temperature characteristics, encountered before, were eliminated in the so-called "potential control" to control latent image conditions by charge quantity, light quantity, etc. with provision of potential measuring means, so as to improve convergence of potential, thereby enhancing the stability of image density further.

Comparative Example 5

Using the temperature control circuit as shown in FIG. 6 and using the heater of the seamless cylinder shape and the flexible type to closely fit the inside surface of the photosensitive member, each of the photosensitive members for electrophotography prepared in Example 4 was set in the test machine modified from NP6750 (trade name) of CANON K.K. and the heater was energized by supplying the power of Example 6 according to the heat capacity of the photosensitive member and controlled so that the temperature of the photosensitive member became 45° C. The time changes of temperature were measured in the continuous sheet pass operation under the ambient at 15° C. The results were as shown in FIG. 12, similar to those in Comparative Example 2.

In this comparative example, as shown in FIG. 12, because the large power was supplied in order to compensate for the temperature decrease due to the sheet pass, there appeared the temperature control ripples and there also appeared the potential unevenness and image density irregularities due to the aforementioned temperature characteristics.

As detailed above, the present invention can provide the electrophotographic, photosensitive member and the image forming apparatus capable of stably providing high-quality images and permitting cost reduction toward improvement in the temperature characteristics.

In addition, the present invention can provide the electrophotographic, photosensitive member permitting the power savings in the production of the electrophotographic, photosensitive member, the decrease of tact time, and the reduction of the production cost, and the image forming apparatus having the photosensitive member.

Further, the present invention can provide the electrophotographic, photosensitive member that can present high-quality images with fewer image defects such as blank area or the like due to the film peeling off of the a-Si(H,X) deposited film and that can be produced at low cost, and the electrophotographic apparatus having the electrophotographic, photosensitive member.

In addition, the present invention can provide the electrophotographic apparatus using the photoconductive member for electrophotography with excellent durability, which can always demonstrate the stable, electrical, optical, and photoconductive characteristics and which suffers no deterioration even in repetitive use.

The electrophotographic, photosensitive member of a-Si (H,X) according to the present invention is formed by the plasma CVD method to induce the discharge at the discharge frequency not less than 50 MHz nor more than 450 MHz, whereby the stress in the film can be made very small. Namely, it becomes possible to use the conductor support not less than 0.1 mm but less than 2.5 mm, which contributes very much to the cost reduction, based on the power savings and the decrease of the tact time because of the decrease of the heating time in the production of the a-Si(H,X) film, the cutback of the high-temperature-maintaining power, the decrease of the tact time because of the decrease of the cooling time, and so on.

Further, according to the present invention, the drum-like metal substrate used is the one having the outside diameter not less than 20 mm nor more than 60 mm, whereby the degree of thermal deformation of the drum-like metal substrate can be suppressed to the sufficiently small level even if the drum-like metal substrate is heated during the production of the photoconductive member and during the use as a photosensitive drum for electrophotography; therefore, the level of the film peeling off of the a-Si(H,X) deposited film can be controlled to the level in which no problem is posed in the practical use, or to zero, and the thickness of the drum-like metal substrate can be not less than 0.1 mm but less than 2.5 mm, thereby permitting the production cost to be curtailed drastically.

When the heater is used in the drum-like metal substrate having the thickness of not less than 0.1 mm but less than 2.5 mm, the high-accuracy temperature control can be effected, because the temperature gradient is small between the heater and the surface of the photosensitive member.

Further, the use of the PTC heater in the seamless structure permits the input of much higher power than for the temperature equilibrium state, so as to increase the response; therefore, quick temperature increase can be performed on one hand and the temperature control can be effected without the overshoots nor temperature control ripples even in the dynamic state with the sheet pass operation on the other hand.

What is claimed is:

1. An electrophotographic, photosensitive member which is cylindrical and comprises a photosensitive layer comprising amorphous silicon provided on an electroconductive substrate, and in which the thickness of the electroconductive substrate is not less than 0.1 mm but less than 2.5 mm, wherein the photosensitive layer is a layer formed by a plasma CVD method to induce a discharge at a discharge frequency of not less than 50 MHz nor more than 450 MHz.

2. An electrophotographic apparatus comprising the electrophotographic, photosensitive member as set forth in claim 1.

3. The electrophotographic apparatus according to claim 2, wherein the electrophotographic, photosensitive member has the electroconductive substrate of a drum shape, and wherein a heater is provided inside a hollow part of the substrate, the heater being a heat-generating member having a positive temperature coefficient of resistance.

4. The electrophotographic, photosensitive member according to claim 1, wherein the base material of the electroconductive substrate is aluminum or an aluminum base alloy.

5. The electrophotographic apparatus according to claim 3, wherein the base material of the electroconductive substrate is aluminum or an aluminum base alloy.

6. The electrophotographic apparatus comprising:

(a) an electrophotographic photosensitive member comprising a photosensitive layer comprising amorphous silicon on a cylindrical electroconductive substrate; and (b) a heat-generating member having a positive temperature coefficient of resistance spaced inside electrophotographic photosensitive member, wherein the cylindrical electroconductive substrate has a thickness in the range from 0.1 mm to less than 2.5 mm and an outside diameter from 20 mm to 60 mm.

7. The electrophotographic apparatus according to claim 6, wherein an exterior surface of the heat generating member congruently contacts a corresponding interior surface of the photosensitive member.

8. The electrophotographic apparatus according to claim 6, wherein the base material of the electroconductive substrate is aluminum or an aluminum base alloy.

* * * * *

UNITED STATES PATENT AND TRADEMARK OFFICE

CERTIFICATE OF CORRECTION

PATENT NO. : 6,110,629
DATED : August 29, 2000
INVENTOR(S) : Toshiyuki Ehara et al.

It is certified that error appears in the above-identified patent and that said Letters Patent is hereby corrected as shown below:

Title page,
Item [56] References Cited, under U.S. PATENT DOCUMENTS
"Shiral" should read -- Shirai --; and "Nakumura" should read -- Nakamura --;

Under FOREIGN PATENT DOCUMENTS

| | | | |
|---|---|---|---|
| Insert: | -- 0594453 | 4/94 | Europe --; |
| | -- 2018446 | 10/79 | Great Britain --; |
| | -- 2102028 | 1/83 | Great Britain --; |
| | -- 0136902 | 14/85 | Europe --; |
| | --0168148 | 1/86 | Europe --; |

Under OTHER PUBLICATIONS

Insert: -- Patent Abstracts of Japan, Vol. 98, No. 2, 1/28 For JP-9-283448. --;
-- Database WPI Sec. CH, Wk 8822, Derwent Publ., AN88 — 151079 (1988) . --;
--Database WPI Sec. CH, Wk 8827, Derwent Publ., AN88 — 185758 (1988). --.

Column 4,
Line 20, "yet" (second occurrence) should be deleted.

Column 5,
Line 3, "tact" should read -- tack --.

Column 21,
Line 49, "before" should read -- before and --.

Column 24,
Line 65, "off/the" should readd -- off the --.

Column 27,
Line 7, "before" should read -- before and --;
Line 55, "of" should be deleted.

Column 28,
Line 19, "of" should be deleted.

UNITED STATES PATENT AND TRADEMARK OFFICE

CERTIFICATE OF CORRECTION

PATENT NO. : 6,110,629
DATED : August 29, 2000
INVENTOR(S) : Toshiyuki Ehara et al.

It is certified that error appears in the above-identified patent and that said Letters Patent is hereby corrected as shown below:

Column 29,
Line 2, "inside" should read -- inside the --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*